US009619962B2

(12) United States Patent
George et al.

(10) Patent No.: US 9,619,962 B2
(45) Date of Patent: Apr. 11, 2017

(54) SYSTEM AND METHODS OF PROVIDING PLAYER SERVICES WITH GAMING DEVICES

(71) Applicant: Konami Gaming, Inc., Las Vegas, NV (US)

(72) Inventors: Jeffrey D. George, Las Vegas, NV (US); Thomas E. Soukup, Las Vegas, NV (US); Edward Sepich, Henderson, NV (US)

(73) Assignee: KONAMI GAMING, INC., Las Vegas, NV (US)

( * ) Notice: Subject to any disclaimer, the term of this patent is extended or adjusted under 35 U.S.C. 154(b) by 226 days.

(21) Appl. No.: 14/488,174

(22) Filed: Sep. 16, 2014

(65) Prior Publication Data

US 2015/0087405 A1 Mar. 26, 2015

Related U.S. Application Data

(60) Provisional application No. 61/881,290, filed on Sep. 23, 2013.

(51) Int. Cl.
*G07F 17/32* (2006.01)

(52) U.S. Cl.
CPC ..... *G07F 17/3225* (2013.01); *G07F 17/3244* (2013.01); *G07F 17/3227* (2013.01)

(58) Field of Classification Search
CPC ..... G07F 17/3225; G07F 17/3244; G07F 17/3227
See application file for complete search history.

(56) References Cited

U.S. PATENT DOCUMENTS 8,429,229 B2 4/2013 Sepich et al.
8,523,063 B1 9/2013 McGhie et al.
2002/0142846 A1 10/2002 Paulsen
(Continued)

FOREIGN PATENT DOCUMENTS

JP 2009-533137 A 9/2009

OTHER PUBLICATIONS

Notice of Reasons for Rejection with English Translation (JP 2014-191041); Dispatched on Nov. 4, 2015.
(Continued)

*Primary Examiner* — Werner Garner
(74) *Attorney, Agent, or Firm* — Howard & Howard Attorneys PLLC

(57) ABSTRACT

A system for use in providing gaming property services to a player via a gaming device is provided. The system includes a gaming property server, a gaming machine, and gaming tracking device. The gaming property server provides gaming property services to the player. The gaming machine includes a gaming display, a display device that is coupled to the gaming display, and a gaming controller that is coupled to the display device. The gaming controller is configured to randomly generate an outcome of a game and transmit game data indicative of the outcome to the display device. The gaming tracking device also includes a web browser program for displaying gaming property services via a website provided by the gaming property server. The display device configured to display a player interaction screen including the outcome of the game and the gaming property services.

21 Claims, 16 Drawing Sheets

(56) References Cited

U.S. PATENT DOCUMENTS

| | | | | |
|---|---|---|---|---|
| 2005/0239546 | A1* | 10/2005 | Hedrick | G07F 17/0014 463/29 |
| 2008/0214287 | A1 | 9/2008 | Lutnick et al. | |
| 2009/0233705 | A1* | 9/2009 | LeMay | G07F 17/32 463/25 |
| 2010/0099484 | A1 | 4/2010 | Sommer et al. | |
| 2010/0240455 | A1* | 9/2010 | Gagner | G07F 17/32 463/30 |
| 2011/0183749 | A1 | 7/2011 | Allen et al. | |

OTHER PUBLICATIONS

Patent Examination Report No. 1 (AU 2014224163); Date of Issue: Jan. 19, 2016.
Patent Examination Report No. 2 (AU 2014224163; O/R 060790.00369); Date of Issue: Jun. 23, 2016.

* cited by examiner

SYSTEM AND METHODS OF PROVIDING PLAYER SERVICES WITH GAMING DEVICES

CROSS-REFERENCE TO RELATED APPLICATION

This application claims priority to U.S. Provisional Application No. 61/881,290, filed Sep. 23, 2013, the disclosure of which is hereby incorporated by reference in their entirety.

TECHNICAL FIELD

The subject matter disclosed herein relates generally to gaming systems and more particularly, to a system and methods for allowing a player to purchase goods and service via gaming devices.

BACKGROUND OF THE INVENTION

The growth and competition in the casino gaming market in recent years has resulted in an increase in the amount of patrons visiting the gaming establishments and the number of gaming devices available for play. Gaming machines, such as slot machines, have become a cornerstone of the gaming industry. In addition, casino operators have expanded the services being offered to patrons such as providing restaurants, shows, retail, and other forms of entertainment within the gaming property to appeal the gaming patron.

Known gaming establishments, such as casinos, use casino staff such a casino hosts or casino floor employees to assists patrons in obtaining the additional services being provided by the casino's. Because known casinos use staff members to assist patrons, the cost of providing these additional entertainment offerings are significantly increased. In addition, because of the limited number of casino employees available to assist patrons, casino patrons may become frustrated and device not to purchase any additional services offered by the casino. Accordingly, new features are necessary to appeal to the patron's interest and enhance patron's access to these services offered by the casinos in order to entice patrons to purchase these services and increase profitability. The present invention is directed to satisfying these needs.

SUMMARY OF THE INVENTION

In one aspect of the present invention, a system for use in providing gaming property services to a player is provided. The system includes a gaming property server, a gaming machine, and gaming tracking device coupled to the gaming property server and the gaming machine. The gaming property server provides gaming property services to the player. The gaming machine includes a gaming display for use in displaying a player interaction screen to the player, a display device that is coupled to the gaming display, and a gaming controller that is coupled to the display device. The display device includes a display controller that is configured to display the player interaction screen on the gaming display. The gaming controller is configured to randomly generate an outcome of a game and transmit game data indicative of the outcome to the display device. The gaming tracking device includes a processor that is programmed to receive gaming property services from the gaming property server and transmit services data indicative of the gaming property services to the display device. The display device configured to receive the game data and the services data from the gaming controller and the gaming tracking device, respectively, and display the outcome of the game and the gaming property services on the player interaction screen. The gaming tracking device also includes a web browser program for displaying a web browser interface on the gaming display to enable the player to access the gaming property services via a website provided by the gaming property server.

In another embodiment, a gaming machine for use in providing gaming property services to a player is provided. The gaming machine includes a gaming display for use in displaying a player interaction screen to the player, a display device that is coupled to the gaming display, a gaming controller that is coupled to the display device, and a gaming tracking device that is coupled to the display device. The display device includes a display controller that is configured to display the player interaction screen on the gaming display. The gaming controller is configured to randomly generate an outcome of a game and transmit game data indicative of the outcome to the display device. The gaming tracking device includes a processor that is programmed to transmit services data indicative of the gaming property services to the display device. The display device is configured to receive the game data and the services data from the gaming controller and the gaming tracking device, respectively, and display the outcome of the game and the gaming property services on the player interaction screen. The gaming tracking device also includes a web browser program that is configured to display a web browser interface on the gaming display to enable the player to access the gaming property services via a services website.

In yet another aspect of the present invention, a method for use in providing gaming property services to a player via a gaming machine is provided. The method includes the steps of receiving, by a gaming controller, a signal indicative of a wager being placed by the player and responsively generating an outcome of a game. The method also includes receiving, by a gaming tracking device, a request from the player to display gaming property services, and receiving, by the gaming tracking device, webpage data indicative of the gaming property services from a gaming property server, and generating a services website including the gaming property services. The services website is configured to allow a player to purchase gaming property services via the services website. The method also includes displaying a player interaction screen on a display device of the gaming machine including a gaming section displaying the outcome of the game and a non-gaming section displaying the services website. The method includes determining if the player purchased gaming property services via the services website and responsively providing an award to the player as a function of the purchased gaming property services.

In another aspect of the present invention, one or more non-transitory computer-readable storage media, having computer-executable instructions embodied thereon, is provided. The computer-executable instructions cause a processor to display a player interaction screen on a gaming display, randomly generate an outcome of a game, and display the game outcome on the player interaction screen. The processor receives webpage data indicative of the gaming property services from a gaming property server and displays a services website including the gaming property services on the player interaction screen. The services website being configured to allow a player to purchase gaming property services via the services website. The processor also determines if the player purchased gaming property services via the services website and responsively provides an award to the player as a function of the purchased gaming property services.

In one aspect of the present invention, a system for providing services to a player and for allowing a player to purchase goods and service via gaming devices is provided. The system includes an embedded web browser in an electronic gaming machine (EGM) to display content on the EGM in a side window. The system includes a touch screen web browser embedded in a gaming tracking device such as, for example a "SYNKBox" (also known as NAMB) which uses Picture-in-Picture display on the EGM and the EGM's touch screen not only displays/interacts with a Casino Property Web Page (or 3rd Party website) but it sends the Player ID and EGM ID with the URL request. By adding the Player ID and EGM ID, it enables the Casino Web Server or downstream to the 3rd Party Web Server a method to identify the player and the player's location. The system is also configured to couple the Casino Web Server and downstream 3rd Party Web Server with a player tracking system (SYNKROS), that enables the ability to not only use information about the player and their location in "targeting the service", controlling access to what services to offer, but also assists in the dispatch of casino employees to the player (such as drink request). The system also couples the Casino Web Server and downstream 3rd Party Web Server with SYNKROS, to enable points that can be earned on the transaction or the player could use their points to pay for the service or wager (i.e., SportsBook). Furthermore, Cashless Wagering could be accessed to pay for the service or wager (i.e., SportsBook).

The system also includes one or more gaming devices, a gaming property management system, a 3rd party services system, and a player management system connected to each of the gaming devices, the gaming property management system, and the 3rd party management system. The player management system is configured to receive player information and gaming device location data from the gaming device, and transmit the received information to the gaming property management system and/or the 3rd party services system. The player management system may also receive information for the gaming property management system and the 3rd party services system and display the received information on the gaming device. The player management system may also allow the player to purchase goods and services from the gaming property management system and 3rd party services system via the gaming device.

The player management system is also configured to display a player interaction screen on the gaming device to enable the player to access services provided by the gaming property management system and/or the 3rd party services system via the player interaction screen. The gaming device is configured to simultaneously display a game and the player interaction screen in a display area to enable the player to simultaneously play a game and purchase/order goods and services with the player interaction screen. The player management system may also enable the player to access player account information, including player account points/award, and purchase goods and services from the gaming property management system and the 3rd party services system with the player account points/awards.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

With reference to the drawings, and in operation, the present invention overcomes at least some of the disadvantages of known systems by providing a system that includes a gaming tracking device that is coupled to a gaming property server and is configured to display gaming services provided by the gaming property server on a gaming machine. More specifically, the gaming tracking device includes a web browser program that is displayed on the gaming machine and is configured to display services websites provided by the gaming property server to enable a player to view, access, and/or purchase gaming property services via the services website. In addition, the gaming tracking device is connected to a player tracking server to identify the player, display services that are associated with a player on the gaming machine, and enable the player to purchase goods and services using player account points via the services website.

In addition the system allows a player to access a corresponding player tracking account and displays a player interaction screen that enables the player to purchase goods and services with points associated with the corresponding player tracking account via the player interaction screens. Moreover, the system includes a gaming device that enables the player to play a game, provides an award to the player as a function of the player's wager and the game outcome, and allows the player to purchase goods and services with the received awards via the player interaction screen. The gaming device is configured to simultaneously display the game and the player interaction screen to enable the player to play games and purchase services via a single gaming device. By providing a system that enables a player to play games, access a player's player tracking account, and purchase goods and services using game awards and/or player tracking points, the player's enjoyment in using the gaming machine is increased, and the amount of time the player spends playing the games in increased, thus increasing the profitability of the gaming device.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 1:
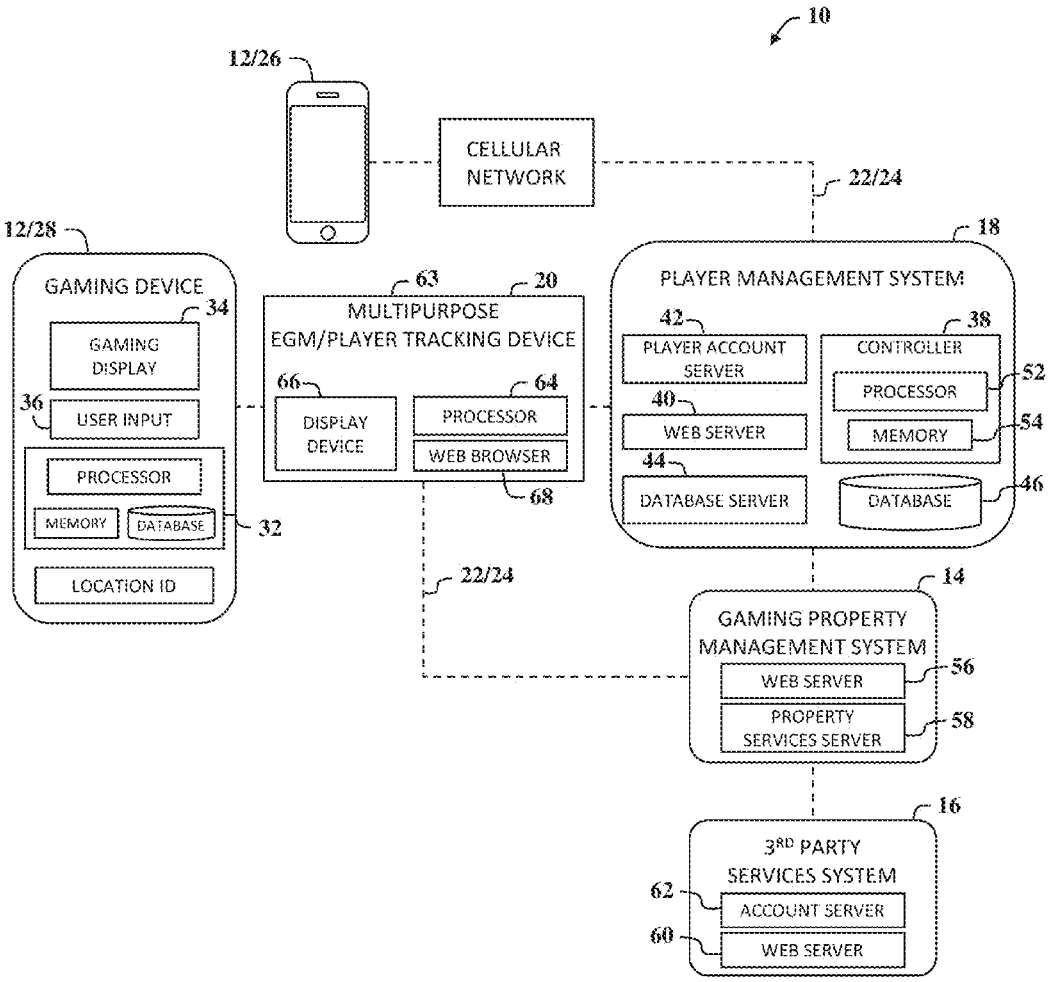
FIG. 1 is a schematic representation of an exemplary system for providing gaming property services to players via a gaming device, according to an embodiment of the present invention.

FIG. 1 is a schematic representation of the system 10, according to an embodiment of the invention. In the illustrated embodiment, the system 10 includes one or more gaming devices 12, a gaming property management system 14, a 3rd party services system 16, and a player management system 18 that is connected to the gaming devices 12, the gaming property management system 14, and the 3rd party services system 16. The system 10 also includes one or more gaming tracking devices 20 that is coupled to a corresponding gaming device 12, the gaming property management system 14, a 3rd party services system 16, and a player management system 18 to transmit and receive data to and/or from the gaming device 12, the gaming property management system 14, the 3rd party services system 16, and the player management system 18 to display graphical interfaces (shown in FIGS. 9-26) on the gaming device 12 to enable a user/player to access and purchase goods and services provided by the gaming property management system 14 and/or the 3rd party services system 16 via the gaming device 12.

In the illustrated embodiment, the gaming tracking device 20, the gaming device 12, the gaming property management system 14, the 3rd party services system 16, and the player management system 18, are coupled together via a communications link 22 that enables each gaming device 12 to access the player management system 18, the gaming property management system 14, and/or the 3rd party services system 16 over a network 24 such as, for example, the Internet, a cellular telecommunications network, a wireless network and/or any suitable telecommunication network. For example, in one embodiment, the gaming device 12 includes a mobile computing device 26, e.g., a smartphone that communicates with the player management system 18 via the cellular telecommunications network and/or the Internet. In another embodiment, the gaming device 12 includes a gaming machine 28 (shown in FIG. 5). In yet another embodiment, the gaming device 12 may include a personal computer, laptop, cell phone, tablet computer, smartphone/tablet computer hybrid, personal data assistant, and/or any suitable computing device that enables a user to connect to the player management system 18 and display the graphical interfaces.

In the illustrated embodiment, each gaming device 12 includes a gaming controller 32 that is coupled to a gaming display 34 and a user input device 36. The gaming controller 32 receives and transmits information to and from the gaming tracking device 20 and/or the player management system 18 and displays the graphical interfaces on the gaming display 34 to enable the user/player to interact with the player management system 18 and/or the gaming tracking device 20 to access a player tracking account, access casino services, and purchase goods and/or services from the gaming property management system 14 and/or the 3rd party services system 16 in accordance with the embodiments described herein. The gaming display 34 includes, without limitation, a flat panel display, such as a cathode ray tube display (CRT), a liquid crystal display (LCD), a light-emitting diode display (LED), active-matrix organic light-emitting diode (AMOLED), a plasma display, and/or any suitable visual output device capable of displaying graphical data and/or text to a user. Moreover, the user input device 36 includes, without limitation, a keyboard, a keypad, a touch-sensitive screen, a scroll wheel, a pointing device, a barcode reader, a magnetic card reader, a radio frequency identification (RFID) card reader, an audio input device employing speech-recognition software, and/or any suitable device that enables a user to input data into the controller 32 and/or to retrieve data from the controller 32. Alternatively, a single component, such as a touch screen, a capacitive touch screen, and/or a touchless screen, may function as both the gaming display 34 and as the user input device 36.

In the illustrated embodiment, the player management system 18 includes a system controller 38, a web server 40, and a player account server 42, a database server 44 and a database 46. The servers 40-44, system controller 38, and database 46 are connected through a network such as, for example, a local area network (LAN), a wide area network (WAN), dial-in-connections, cable modems, wireless modems, and/or special high-speed Integrated Services Digital Network (ISDN) lines.

The web server 40 communicates with the gaming devices 12, the gaming property management system 14, and the 3rd party services system 16 to facilitate transmitting data over the network 24 via the Internet and/or the cellular network, respectively.

The database server 44 is connected to the database 46 to facilitate transmitting data to and from the database 46. The database 46 contains information on a variety of matters, such as, for example, player account information, gaming property information, 3rd party information, image data for producing graphical interfaces and/or screens on the gaming device 12 and temporarily stores variables, parameters, and the like that are used by the system controller 38. In one embodiment, the database 46 includes a centralized database that is stored on the system 10 and is accessed directly via the gaming devices 12 and/or the gaming tracking device 20. In an alternative embodiment, the database 46 is stored remotely from the system 10 and may be non-centralized.

The player account server 42 receives player tracking data from the gaming tracking device 20 and generates and stores the received player tracking data in corresponding player accounts stored in the database 46. In addition, the player account server 42 retrieves a player account and transmits the player tracking data to the gaming tracking device 20, the gaming device 12, the gaming property management system 14 and/or the 3rd party services system 16.

The system controller 38 includes a processor 52 and a memory device 54 that is coupled to the processor 52. The memory device 54 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the processor 52 to store, retrieve, and/or execute instructions and/or data.

The processor 52 executes various programs, and thereby controls other components of the system 10, the gaming tracking device 20, and the gaming devices 12 according to user instructions and data received from the gaming devices 12. The processor 52 in particular executes a program, and thereby enables the system 10 to allow the player to access information, goods, and/or services provided by the player account server 42, the gaming property management system 14, and the 3rd party services system 16 in response to user instructions received via the gaming devices 12 in accordance with the embodiments described herein. The memory device 54 stores programs and information used by the processor 52. Moreover, the memory device 54 stores and retrieves information in the database 46 including, but not limited to, image data for producing images and/or screens on the gaming display 34, and temporarily stores variables, parameters, and the like that are used by the processor 52.

In the illustrated embodiment, a player may use the gaming device 12 to access goods and services provided by the gaming property management system 14 and/or the 3rd party services system 16 such as, for example, restaurant reservations, show reservations, casino services, hotel services, travel arrangements, and/or any suitable goods and/or services that enables the system 10 to function as described herein. In addition, the player may access a corresponding player tracking account with the gaming device 12. As described herein, the player may enter a unique player identifier (ID) using the gaming device 12 that corresponds to a player tracking account. The gaming tracking device 20 transmits the player ID to the player management system 18 to determine a corresponding player tracking account. The gaming tracking device 20 may also receive the location ID associated with the gaming device 12 and transmit the player account information and the gaming device location ID to the gaming property management system 14 and/or the 3rd party services system 16. The gaming property management system 14 and/or the 3rd party services system 16 may select services associated with the received player account information and/or the gaming device location and transmit data indicative of the selected services to the player management system 18 and/or the gaming tracking device 20 to display the services on the gaming device 12.

In the illustrated embodiment, the gaming property management system 14 includes a web server 56 that is configured to facilitate communication of data to and/or from the gaming tracking device 20, the player management system 18, and/or the 3rd party services system 16. The gaming property management system 14 may also include a property services server 58 that is configured to transmit data indicative of goods and services offered by the gaming property to the player management system 18 and/or the gaming tracking device 20 as a function of the received player ID and/or gaming device location. The 3rd party services system 16 includes a web server 60 to facilitate communicating with the gaming property management system 14 and/or the player management system 18, and an account server 62 that is configured to transmit data indicative of the goods and services provided by the 3rd party service system as a function of the received player ID and/or the gaming device location.

In the illustrated embodiment, the gaming tracking device 20 is coupled to the gaming device 12 and the gaming property management system 14 to receive gaming property services from the gaming property management system 14 and display the gaming property services on the gaming display 34. Moreover, the gaming tracking device 20 is configured to receive gaming property services from the gaming property server and transmit services data indicative of the gaming property services to gaming device 12. In one embodiment, the gaming tracking device 20 is a multipurpose EGM/player tracking device that is connected to one or more gaming machines 28. Additional details of multipurpose EGM/player tracking devices, which may be used in the present invention, are described in U.S. patent application Ser. No. 12/235,237 to Edward Sepich et al., now U.S. Pat. No. 8,429,229, filed Sep. 22, 2008, titled "Multipurpose EGM/player Tracking Device and System", which is incorporated herein by reference in its entirety.

In the illustrated embodiment, the gaming tracking device 20 includes a housing 63 that contains a processor 64 and a display device 66 configured to control and/or drive the gaming display 34 included with the gaming device 12. The gaming tracking device 20 also includes a web browser program 68 for use by the processor 64 to generate and display a web browser interface 70 (shown in FIGS. 6-24). The web browser interface 70 enables a player to access the gaming property services via a website provided by the gaming property management system 14. In one embodiment, the gaming tracking device 20 is configured to receive webpage data indicative of the gaming property services from the gaming property web server 56 and/or the 3rd Party web server 60, generate a services webpage as a function of the received webpage data, and transmit the services webpage to the gaming device 12 for use in displaying the services webpage on the gaming display 34. In addition, the gaming tracking device 20 may be configured to transmit information between the player and the gaming property server 56 and/or server 60 via the services webpage to facilitate providing gaming property services to the player.

In the illustrated embodiment, the display device 66 is configured to display a player interaction screen 72 including a gaming content section 74 and a non-gaming content section 76 using a picture-in-picture display. Moreover, the display device 66 displays a game 78 being generated by the gaming controller 32 within the gaming content section 74 and displays a services website 80 in the non-gaming content section 76. More specifically, the display device 66 is configured to receive game data indicative of game play from the gaming controller 32, receive services data indicative of the services website 80 including the gaming property services from the gaming tracking device 20 and display the game and the gaming property services on the player interaction screen 72. In one embodiment, the gaming display 34 includes a touchscreen. The display device 66 relates player selections received via the touchscreen to the gaming tracking device 20 to enable the gaming tracking device 20 to allow the player to interact with the services website 80 via the touchscreen. Similarly, the display device 66 transmits player selections to the gaming controller 32 to enable the gaming controller 32 to conduct game play in response to players selections. In the illustrated embodiment, the display device 66 may adjust a size, orientation, and/or position of each of the gaming content section 74 and the non-gaming content section 76 based on the input received from the player. For example, in one embodiment, the display device 66 may allow the player to select a region on the touchscreen corresponding to the services website 80 being displayed in the non-gaming content section 76 and enlarge the non-gaming content section 76 to allow a larger portion of the services website 80 to be viewable to the player on the gaming display 34.

In one embodiment, the gaming tracking device 20 may display advertising information received from the gaming property server 56 and/or the 3rd party server 60 in the non-gaming content section 76 of the player interaction screen 72. In addition, the gaming tracking device 20 may receive and display a live video broadcast image of a sporting event, gaming tournament, or special event provided by the gaming property server 56 and/or the 3rd party server 60. In addition, the gaming tracking device 20 may display images indicative of bonus feature games, such as progressive games, slot tournaments, and/or system based awards that are received for the player management system 18. In addition, the gaming tracking device 20 may display player information obtained from a player account associated with the player in the non-gaming content section 76.

In one embodiment, the gaming tracking device 20 is configured to transmit a webpage request to the gaming property server 56 and/server 60 to display the services webpage on the gaming display 34. The webpage request may include a URL and a unique player identifier associated with the player for use by the gaming property management system 14 to determine the gaming property services provided to the player as a function of the unique player identifier. Moreover, the gaming tracking device 20 may be configured to determine a unique machine identifier associated with the gaming device 12 and transmit the webpage request including the unique machine identifier to the gaming property server 56 to enable the gaming property management system 14 to determine a location of the gaming device 12 as a function of the unique machine identifier, and to determine the gaming property services being provided to the player as a function of the location of the gaming device 12.

The gaming tracking device 20 may also monitor and track the property services being accessed by the player via the website 80, and generate and transmit tracking data indicative of the player's activity and services accessed through the website to the player management system 18 for use in storing the tracking data in a corresponding player account. In addition, the gaming tracking device 20 may determine if the player purchases one or more gaming property services through the services website 80 and responsively provide an award to the player as a function of the purchased gaming property service. For example, in one embodiment, the gaming property may provide an incentive to the player to use the services website. The gaming tracking device 20 may detect when the player accesses the services website and provide bonus points, loyalty points, and/or cashless wagering credits to the player as an award for accessing and/or purchasing gaming property services via the services website 80.

In one embodiment, the gaming tracking device 20 may be configured to determine a player account associated with the player as a function of the unique player ID, and allow the player to purchase gaming property services via the services website 80 using bonus points contained in the player account. In addition, the gaming tracking device 20 may allow the player to purchase gaming property services via the services webpage 80 using cashless wagering credits associated with the player account. For example, in one embodiment, the gaming tracking device 20 may determine a player account associated with the player as a function of the unique player identifier, determine an amount of bonus points and cashless wagering credits included in the player account; and allow the player to purchase gaming property services via the services website with the bonus points and cashless credits included in the player account.

Figure 2:
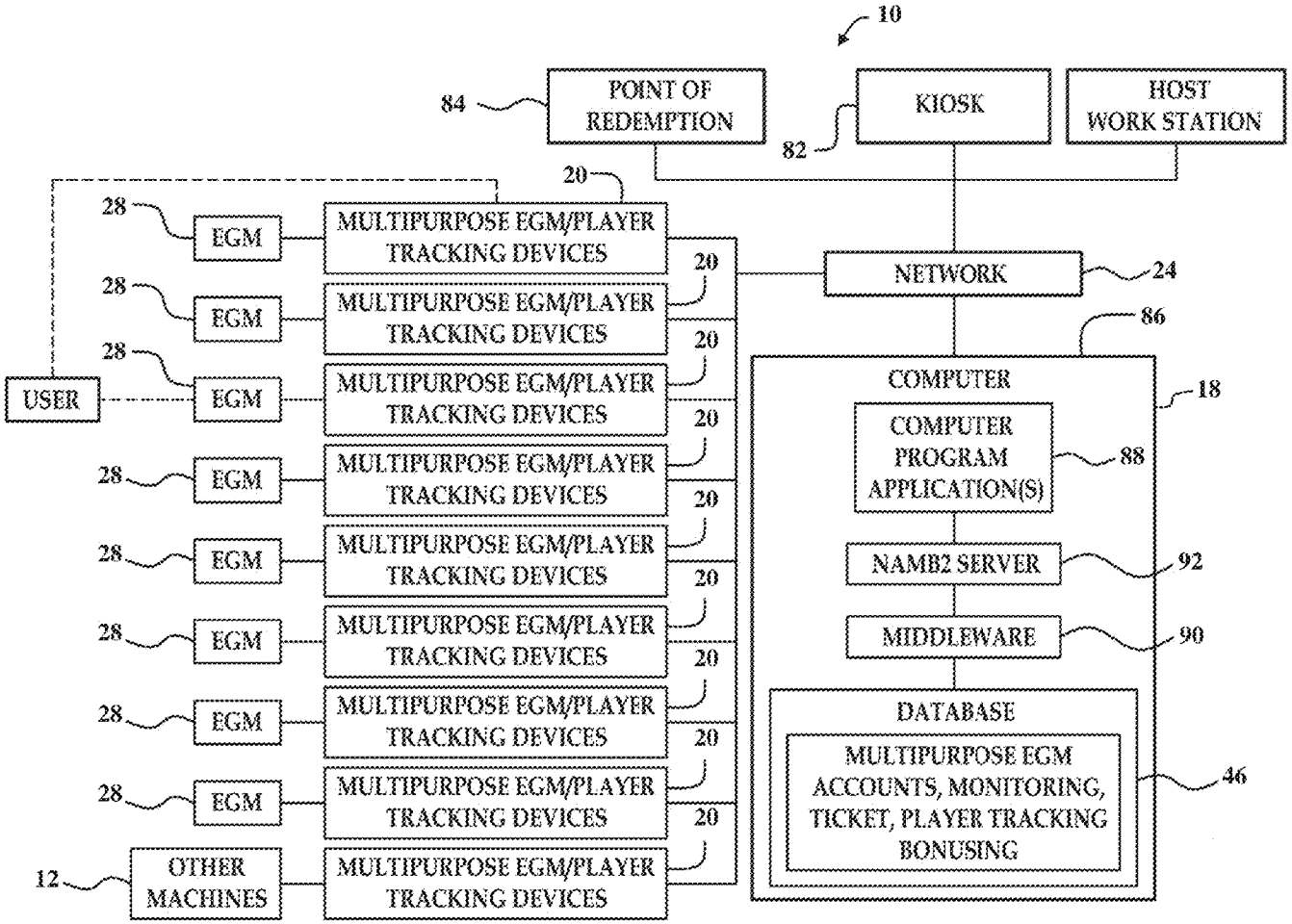
FIGS. 2 and 3 are additional schematic representations of the system shown in FIG. 1, according to an embodiment of the present invention.
Figure 3:
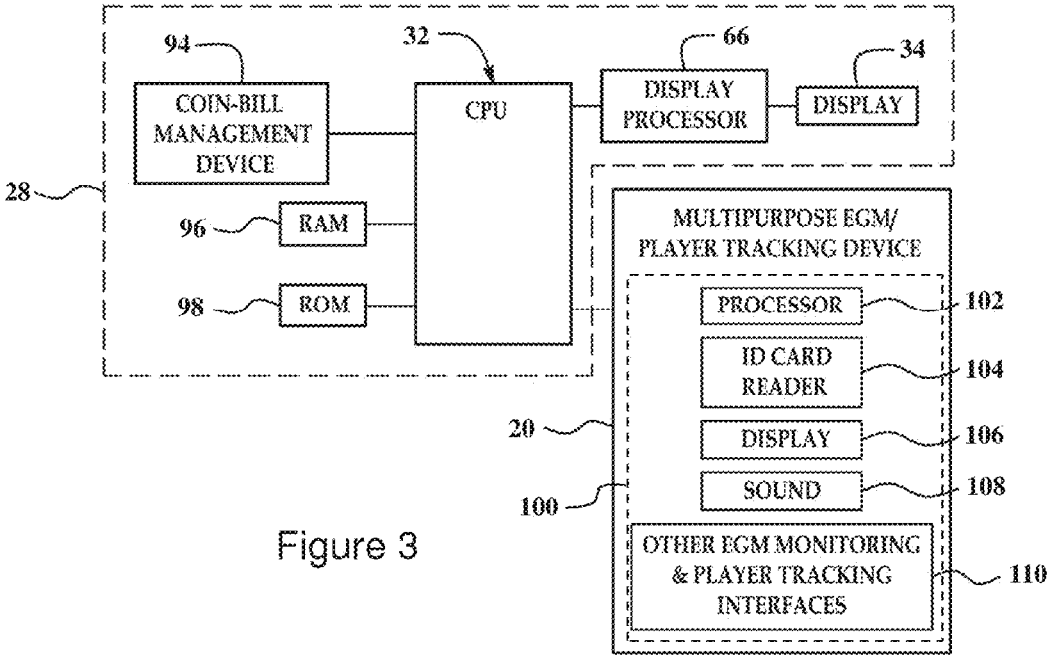

Referring to FIGS. 2 and 3, in the illustrated embodiment, the system 10 may be configured to provide accounting, monitoring, and/or other gaming related services, such as, ticking, progressives, gaming attending, and/or EGM interaction services, and provide a player additional services, such as, player tracking, points management, bonusing, multimedia content and/or entertainment services. For example, in one embodiment, the system 10 may be embodied or implemented via an entertaining management and monitoring system (shown in FIG. 2) and may include many additional functions such as real-time multi-site, EGM accounting, EGM monitoring, player tracking, cage credit and vault, sports book, Point of Sale (POS) accounting, keno accounting, bingo accounting, and table game accounting, a wide area progressive jackpot, and electronic funds transfer (EFT), as well as interfaces to other gaming and non-gaming systems. In addition, the system 10 may be configured to track data related to the play of one or more gaming devices 12. Two such systems are disclosed in U.S. patent application Ser. No. 11/094,605, filed Mar. 30, 2005, which is hereby incorporated by reference.

As shown, the system 10 includes a plurality of EGMs 28. Gaming machines 28 may include, but are not limited to, EGMs, electronic gaming machines (such as video slot, video poker machines, or video arcade games), multi-terminal electronic gaming machines, server-based gaming machines, virtual EGMs, e.g., for online gaming, and an interface to a table management system (not shown) for table games, or other suitable devices at which a user may interact or access a user or player account. In the illustrated embodiment, eight electronic game machines (EGMs) 28 are shown. However, it should be noted that the present invention is not limited to any number or type of gaming machine 28. In one embodiment, the gaming machines 28 are organized into banks (not shown), each bank containing a plurality of gaming machines 28. Moreover, the system 10 may include other types of gaming devices 12 such as, for example, kiosks 82 and/or point of sale or redemption terminals 84.

In the illustrated embodiment, the player management system 18 may include one or more host computers 86. The gaming machines 28 are connected via a network 24 to one or more host computers 86, which are generally located at a remote or central location. The host computer 86 includes computer program application(s) 88 which maintains one or more databases 46. The computer program application(s) 88 and databases 46 may be used to record, track, and report accounting and monitoring information regarding the EGMs 28 and players and/or gaming attendant/casino employee interaction via the gaming devices 12. Additionally, the computer program application(s) 88 and databases 46 may be used to maintain information related to player or player tracking accounts.

In general, the gaming machines 28 may be used by a user or player, i.e., to access their player account or services through the gaming tracking device 20, i.e., the multipurpose EGM/player tracking device. Examples of player services include, but are not limited to, accessing and performing operations on (1) point and complementary point balances, (2) accessing and performing operations on awards such as, bonuses, incentives, progressives etc., (3) accessing and performing operations on saved player preferences and account information such as, PIN, default language, show/hide points, and other player and Bonusing features. For example, the player may select one of the gaming machines 28 to play a game and insert a coin, credit, coupon, and/or player tracking card (not shown) into the chosen gaming machine 28. Generally, the gaming machine 28 has an associated number of credits or coins required in order to play. In the case of video slot or poker games, the game is played and an award or Bonus in the form of credits or other complementary points may be awarded through the multipurpose EGM/player tracking device 20 to the gaming machine 28. In the case where the user is a gaming attendant and/or gaming property employee, the gaming attendant may interact with the multipurpose EGM/player tracking device 20 to access gaming machine 28 services, such as, perform a fill, acknowledge a jackpot, link or associate a particular multipurpose EGM/player tracking device to the gaming machine 28, interrogate gaming machine 28 meters, bill insertions and other access or perform other EGM specific gaming services.

In one embodiment, the player management system 18 may also include one or more middleware servers 90. Each middleware server 90 being associated with one or more gaming machines 28. The middleware server 90 acts as go-between between the associated gaming machines 28 and multipurpose EGM/player tracking devices 20 and one or more database servers 44 which are used to provide game services, e.g., progressive awards, player tracking services, accounting services, and the like. The player management system 18 may also include a NAMB2 server 92 that may be used to download software executables to each multipurpose EGM/player tracking device 20 and uses a checksum process (e.g., MD5SUM signature) to verify the software. The NAMB2 server 92 may also provide entertainment audio or video streams to each multipurpose EGM/player tracking device 20 over the communications link 22 as well as other player and gaming attendant services such as, remote help, Internet access, and non-gaming revenue services such as, reservations, valet, shopping, and others.

With reference to FIG. 3, in one embodiment, the gaming machine 28 may include gaming controller 32, or central processing unit (CPU), a coin-bill management device 94, a display processor/device 66, a RAM 96 as a memory device and a ROM 98 (generally provided as an EPROM). The CPU 32 is mainly composed of a microprocessor unit and performs various calculations and motion control necessary for the progress of the game. The coin-bill management device 94 detects the insertion of a coin or a bill and performs a necessary process for managing the coin and the bill. The display processor 66 interprets commands issued from the CPU 32 and displays desirable images on a display 34. The RAM 96 temporarily stores programs and data necessary for the progress of the game, and the ROM 98 stores, in advance, programs and data for controlling basic operation of the EGM 28, such as the booting operation thereof, game code and graphics. Input to the EGM 28 may be accomplished via mechanical switches or buttons or via a touchscreen interface (not shown).

In one embodiment, the gaming tracking device 20 may include a player tracking device 100 that is connected to the gaming machine 28 for use in identifying a player and/or gaming attendant to access player accounts stored on the database 46. The player or gaming attendant user is identified via a player tracking card and/or any other method of identifying the player or gaming attendant, such as, finger print, optical recognition, etc., into the player tracking device 100 at each gaming machine 28. Player tracking accounts may be used, generally, to provide bonuses to a player, in addition to the award designated by, in the case of a video slot or poker machine, the gaming machine 28 paytable. These bonuses may be awarded to the player based a set of criteria, including, but not limited to, a) the player's play on the EGM 28, b) the player's overall play, c) play during a predetermined period of time, and d) the player's birthday or anniversary, or e) any other definable criteria. Additionally, bonuses may be awarded on a random basis, i.e., to a randomly chosen player or randomly chosen game. Bonuses may also be awarded in a discretionary manner or based on other criteria, such as, purchases made at a gift shop or other affiliated location. Additionally, bonuses may be awarded to the player from any other gaming or non-gaming source, such as, Point of Service (POS), Property Management Systems (PMS), Kiosks, or any other interfaced external system.

Bonus awards may be provided to a player and stored in a corresponding player account for use by the player to purchase goods and/or services offered by the gaming property via the services website 80 and/or for placing wagers on games being played on the gaming machine 28. In one embodiment, bonus awards include bonus points that may include incentive points. Incentive points may be exchanged for game play, gifts and/or property services, such as hats, t-shirts, meals, shows, and/or property amenities such as spa/pool services, nightclub services, etc.

In another embodiment, the bonus points may also be convertible to gaming credits, which may be designated as cashable or non-cashable. Cashable credits, or incentive points converted into credits, may be downloaded to a gaming machine 28. When the player has finished playing the EGM 28, any remaining credits may be cashed out, i.e., retrieved as coins or placed on a printed ticket or player tracking card for redemption or play on another gaming machine 28. In addition, cashable credits may be used to purchase goods and/or services provided by the gaming property management system 14 and/or the 3rd Party services system 16 via the services website 80 displayed on the gaming machine 28.

Non-cashable credits must be used for game play and/or wagering on games being played with the gaming machine. When the player stops playing an EGM 28, any remaining non-cashable credits which were downloaded to the EGM 28 are either lost or uploaded back to the player account.

In one embodiment, the player tracking device 100 may include a processor 102, a player identification card reader 104 and/or a numeric keypad (not shown), a display 106, a sound project device 108 and other EGM monitoring and player/gaming attendant tracking interfaces 110. In one embodiment, the display 106 is a touchscreen panel and the numeric keypad (not show) is implemented thereon.

The player may be identified by entry of a player tracking card into the player identification card reader 104 and/or entry of a player identification number (PIN) on the numeric key pad or touch screen panel display 106 or any other method of identifying the player or gaming attendant, such as, finger print, optical recognition, etc. The player tracking device 100 may also be used to communicate information between the computer 86 (FIG. 1) and the corresponding EGM 28. The player tracking device 100 may also be used to track bonus points, i.e., incentive points or credits, downloaded from the computer 86 (FIG. 1).

In the illustrated embodiment, each gaming machine 28 is connected to an associated gaming tracking device 20. Each gaming tracking device 20 includes a first communication interface and a second communication interface. The first communication interface is used to communicate with the corresponding gaming machine 28 over a machine communications link and may include a dual-purpose port, which may for example be used to implement two different communication links, e.g., RS-232 and a current loop communications link. The second communication interface is generally an Ethernet port and is used to communicate with a middleware server 90 over a systems communications link. In the illustrated embodiment, the systems communications link is an Ethernet link. Data is communicated over the systems communications link in data packets in a system communications protocol. Thus, data, including game software in downloadable gaming systems, meter information, accounting information, progressive information, video, and the like, may be communicated over the Ethernet connections between the middleware server 90 to the gaming machine 28 through the gaming tracking devices 20.

In the illustrated embodiment, the gaming tracking device 20 is capable of transmitting data using various types of communication links and various communication protocols. In one embodiment, the gaming tracking device 20 may communicate with the gaming machine 28 using any communications protocol and may be configured to implement multiple communications links, including for example, RS-232, RS-485, Ethernet, current loops, fiber optics, and/or USB. For example, the communications protocol used by each gaming machine 28 may be different even among gaming machines 28 associated with the same middleware server 90. If one of the gaming machines 28 communicates using the SAS protocol, then the corresponding gaming tracking device 20 may be configured to use a RS-232 gaming communications link and a SAS communications protocol over the RS-232 link. Moreover, if another of the gaming machines 28 is a G2S device, i.e., communicates using the G2S protocol, then the associated gaming communications data link may be an Ethernet link and the associated gaming tracking device 20 communicates with the associated gaming machine 28 over the Ethernet link using the G2S protocol.

In addition, in one embodiment, the display device 66 drives the gaming display 34 through an appropriate port (not shown), such as a VGA port. Additionally, another port, e.g., another VGA port, may also be provided by the gaming tracking device to drive an additional displays such as the player tracking display 106. The additional display may be on the EGM 28, or external to the EGM or an external display. The additional display may be used, e.g., to show or play data, e.g., (without limitation) graphics, video, animations, pictures, sound, etc. . . . , which may be related to a particular EGM 28, related to a bank or group of EGMs (such as for a Progressive Game), or for another purpose.

Thus, the gaming tracking device 20 provides a system architecture which is more flexible, e.g., EGMs which require communication using different communication protocols, e.g., SAS and/or G2S may be mixed and matched in the same area or bank and associated with the same middleware. Furthermore, the present invention provides a system architecture which may communicate with game machines which require use of a communication protocol which requires a high bandwidth, e.g., the G2S protocol without requiring multiple communication links from the EGMs and/or associated device back to a computer or server at a remote location.

Figure 5:
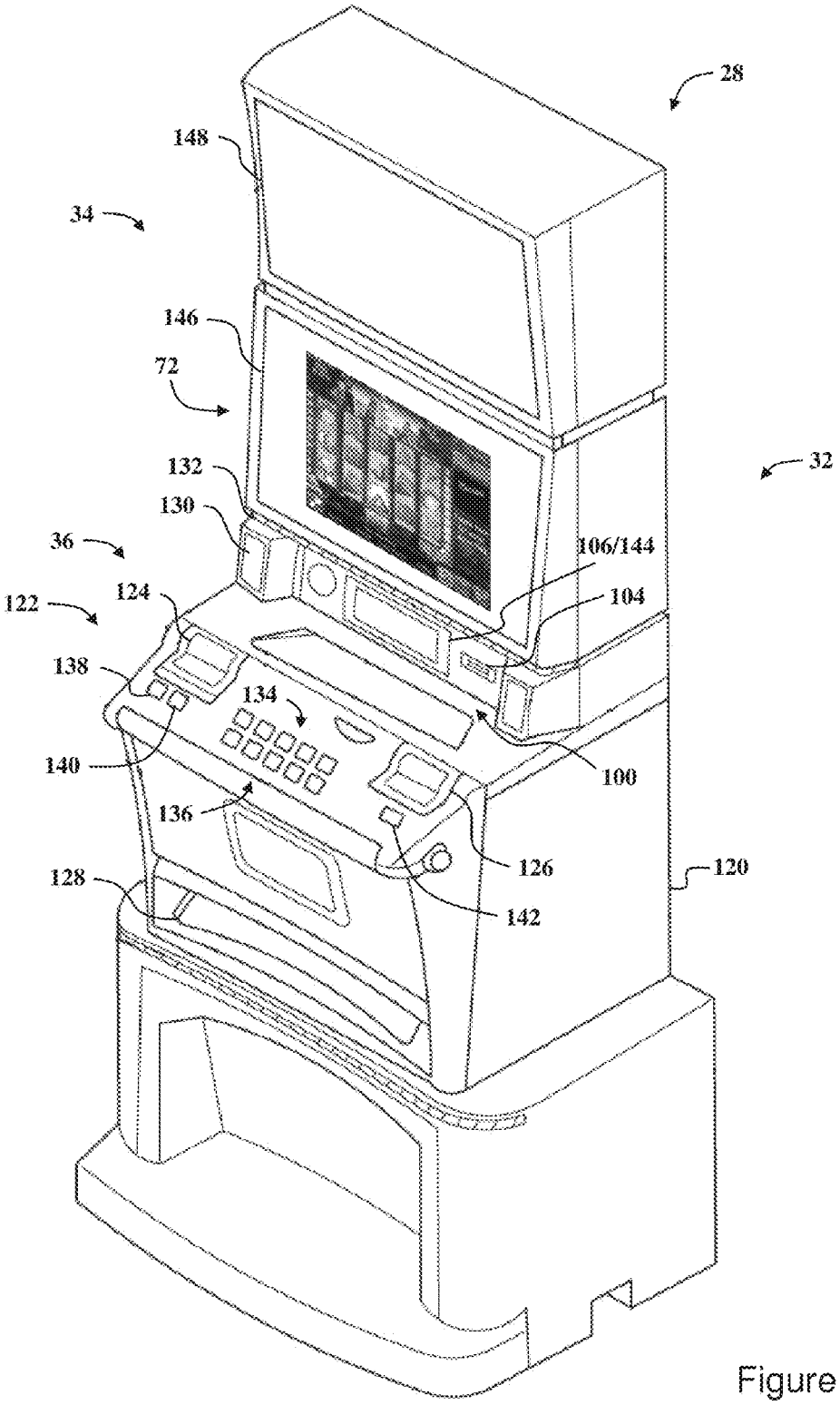
FIG. 5 is a perspective view of an exemplary gaming device that may be used with the system shown in FIGS. 1 and 2, according to an embodiment of the present invention.
Figure 6:
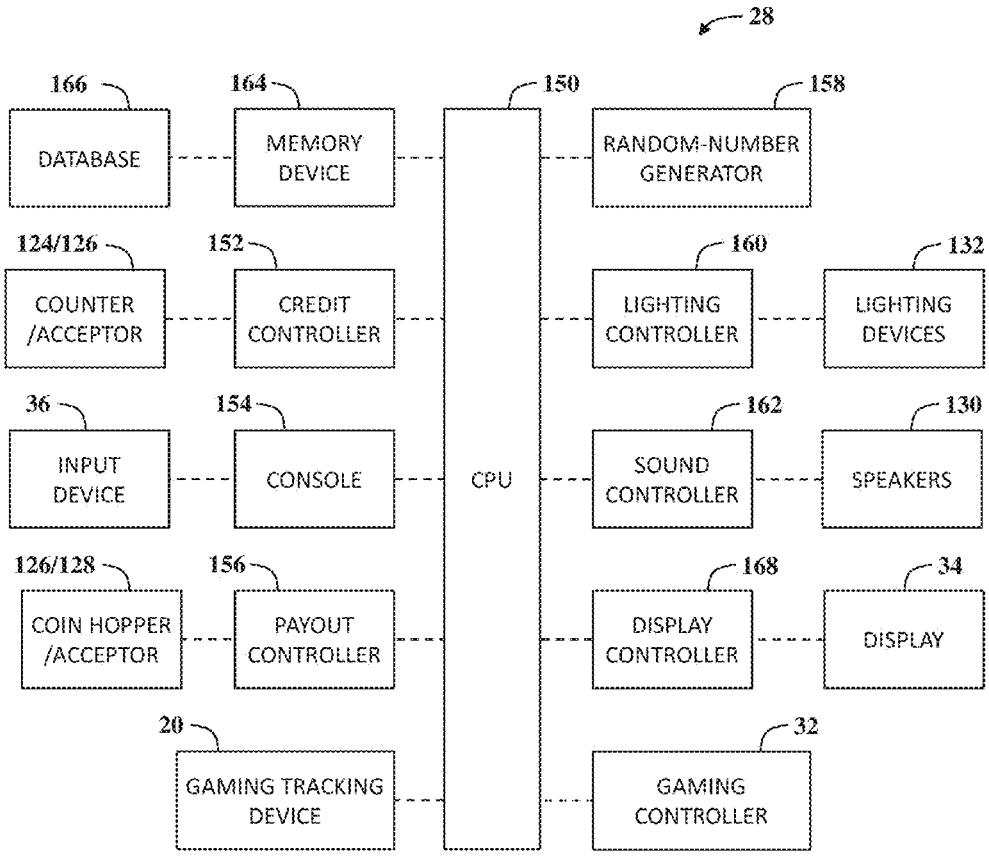
FIG. 6 is a schematic representation of the gaming device shown in FIG. 5, according to an embodiment of the present invention.

FIG. 5 is a perspective view of an exemplary gaming machine 28. FIG. 6 is a schematic representation of the gaming device 28. In the illustrated embodiment, the gaming machine 28 is a video gaming machine preferably installed in a casino. In the illustrated embodiment, the gaming machine 28 includes a gaming display 34 for displaying a plurality of games, a user input device 36 to enable a player to interface with the gaming machine 28, and a gaming controller 32 that is operatively coupled to the gaming display 34 and the user input device 36 to enable a player to play games displayed on the gaming display 34. The gaming machine 28 also includes a cabinet assembly 120 that is configured to support the gaming display 34, the user input device 36, and/or the gaming controller 32 from a gaming stand and/or a supporting surface.

The gaming display 34 and the user input device 36 are coupled to the cabinet assembly 120 and are accessible by the player. In one embodiment, the gaming controller 32 is positioned within the cabinet assembly 120. Alternatively, the gaming controller 32 may be separated from the cabinet assembly 120, and connected to components of the gaming machine 28 through a network such as, for example, a local area network (LAN), a wide area network (WAN), dial-in-connections, cable modems, wireless modems, and/or special high-speed Integrated Services Digital Network (ISDN) lines.

In one embodiment, the user input device 36 includes a plurality of input buttons 122, a coin slot 124, and/or a bill acceptor 126. The coin slot 124 includes an opening that is configured to receive coins and/or tokens deposited by the player into the gaming machine 28. The gaming machine 28 converts a value of the coins and/or tokens to a corresponding amount of gaming credits that are used by the player to wager on games played on the gaming machine 28.

The bill acceptor 126 includes an input and output device that is configured to accept a bill, a ticket, and/or a cash card into the bill acceptor 126 to enable an amount of gaming credits associated with a monetary value of the bills, ticket, and/or cash card to be credited to the gaming machine 28. Moreover, the gaming machine 28 may also utilize a cashless wagering system (not shown), such as a ticket in ticket out (TITO) system (not shown). In one embodiment, the bill acceptor 126 also includes a printer (not shown) that is configured to dispense a printed voucher ticket that includes information indicative of an amount of credits and/or money paid out to the player by the gaming machine 28 during a gaming session. The voucher ticket may be used at other gaming machines, or redeemed for cash, and/or other items as part of a casino cashless system (not shown).

A coin tray 128 is coupled to the cabinet assembly 120 and is configured to receive a plurality of coins that are dispensed from the gaming machine 28. One or more speakers 130 are installed inside the cabinet assembly 120 to generate voice announcements and/or sound effects associated with game play. The gaming machine 28 also includes one or more lighting devices 132 that are configured to blink and/or change brightness and color in specific patterns to produce lighting effects to enhance a visual gaming experience for the player.

In one embodiment, the input buttons 122 include a plurality of BET switches 134 for inputting a wager on a game, a plurality of selection switches 136 for selecting a betting line and/or card, a MAXBET switch 138 for inputting a maximum wager, a PAYOUT switch 140 for ending a gaming session and dispensing accumulated gaming credits to the player, and a start switch, i.e., a SPIN/DEAL button 142 to initiate an output of a game.

In the illustrated embodiment, the BET switches include five switches from 1BET to 5BET to enable a player to wager between a minimum bet up to 5× minimum bet. Each selection switch corresponds to a betting line such as, for example, a payline and/or symbol for a reel game, one or more cards for a card game, and/or a symbol for a roulette game, to enable a player to associate a wager with one or more betting lines. The MAXBET switch enables a player to input the maximum bet that a player can spend against one play of a game. The PAYOUT switch enables a player to receive the amount of money and/or credits awarded to the player during a gaming session, which has been credited onto the gaming machine 28.

The gaming machine 28 may also include the player tracking device 100 that is coupled to the gaming controller 32 and to the gaming tracking device 20 for identifying the player and/or a player tracking account that is associated with the player. The player tracking account may include, but is not limited to, gaming credits available to the player for use in playing the gaming machine 28. The player tracking device 100 is configured to communicate player account information between the player management system 18, the gaming tracking device 20, and the gaming machine 28. For example, the player tracking device 100 may be used to track bonus points and/or credits awarded to the player during a gaming session and/or track bonus and/or credits downloaded to the gaming machine 28 from the player management system 18.

In one embodiment, the player tracking device 100 is coupled to the gaming cabinet assembly 120 and includes a player identification card reader 104, a data display 106, and a keypad 144. The player identification card reader 104 is configured to accept a player tracking card (not shown) inserted by the player, and read information contained on the player tracking card to identify the player account information. The player identification card reader 104 may include, but is not limited to, a barcode reader, a magnetic card reader, and/or a radio frequency identification (RFID) card reader. The keypad 144 is configured to accept a user selection input such as, for example, a unique player personal identification number (PIN) to facilitate enabling the gaming machine 28 to identify the player, and access player account information associated with the identified player to be displayed on the data display 106. In one embodiment, the data display 106 includes a touchscreen panel that includes the keypad 144. Alternatively, the data display 106 and the keypad 144 may be included in the gaming display 34.

In one embodiment, the gaming display 34 includes a first display 146 and a second display 148. The first display 146 is configured to display the player interaction screen 72 including indicia and/or symbols for use in a game, e.g., cards used by a card game, roulette wheel and symbols used in a roulette game, and reels used in a reel game. The player interaction screen 72 may include any type of game including, but not limited to, a video slot game, a keno game, a blackjack game, a video poker game, or any type of game which allows a player to make a wager, play a game, and potentially provide the player an award based on an outcome of the game and a paytable. The player interaction screen 72 may also include a gaming area 74 and a player interaction area 76. The gaming area 74 is configured to display the game and the player interaction area 78 is configured to display a player interaction screen 72.

The second display 148 is configured to display game play instructions for performing the game including, but not limited to, playing instructions, paytables, paylines, betting lines and/or any other information to enable the gaming machine 28 to function as described herein. Moreover, each display 146 and 148 may be configured to display at least a portion of the player interaction screen 72 and/or game play instructions. In one embodiment, the first and second displays 146 and 148 each include a flat panel display, such as a cathode ray tube display (CRT), a liquid crystal display (LCD), a light-emitting diode display (LED), a plasma display, and/or any suitable visual output device capable of displaying graphical data and/or text to a user. Alternatively, a single component, such as a touch screen, may function as both the gaming display 34 and as the user input device 36. In an alternative embodiment, the first display 146 and/or the second display 148 includes a plurality of mechanical reels displaying a plurality of game symbols.

Referring to FIG. 3, in one embodiment, the gaming controller 32 includes a processor, i.e., a central processing unit (CPU) 150, the gaming controller 32, a credit controller 152, a console unit 154, a payout controller 156, a random-number generator (RNG) 158, a lighting controller 160, a sound controller 162, a memory device 164, a database 166, and a display controller 168. Memory device 164 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 150 to store, retrieve, and/or execute instructions and/or data.

The CPU 150 executes various programs, and thereby controls other components of the gaming machine 28 according to player instructions and data accepted by the user input device 36 and/or the gaming display 34. The gaming controller 32 in particular executes a game program, and thereby conducts a game in accordance with the embodiments described herein. The memory device 164 stores programs and databases used by the gaming controller 32. Moreover, the memory device 164 stores and retrieves information in the database 166 including, but not limited to, a game type, a number of reels associated with a game, a number of symbol positions being displayed on each reel, a type of symbols being displayed on each symbol position, a predefined set of normal symbols, a predefined set of special symbols, image data for producing game images and/or screens on the gaming display 34, and temporarily stores variables, parameters, and the like that are used by the gaming controller 32. In addition, the memory device 164 stores indicia, symbol weights, paytables, and/or winning combination tables which represent relationships between combinations of random numbers and types of awards. In one embodiment, the memory device 164 utilizes RAM to temporarily store programs and data necessary for the progress of the game, and EPROM to store, in advance, programs and data for controlling basic operation of the gaming machine 28, such as the booting operation thereof.

The credit controller 152 manages the amount of player's credits, which is equivalent to the amount of coins and bills counted and validated by the bill acceptor 126. The console unit 154 is coupled to the user input device 36 to monitor player selections received through the input buttons 122, and accept various instructions and data that a player enters through the input buttons 122. The payout controller 156 converts a player's credits to coins, bills, or other monetary data by using the coin tray 128 and/or for use in dispensing a credit voucher via the bill acceptor 126.

The lighting controller 160 controls one or more lighting devices 132 to blink and/or change brightness and color in specific patterns in order to produce lighting effects associated with game play. The sound controller 162 controls the speakers 130 to output voice announcements and sound effects during game play.

The RNG 158 generates and outputs random numbers to the gaming controller 32 preferably at the start of each round of a game. The gaming controller 32 uses the random numbers to determine an outcome of the game. For example, if the game is a video slot game, the gaming controller 32 uses the RNG 158 to randomly select an arrangement of symbols to be displayed on video reels. Moreover, the gaming controller 32 generally uses random numbers generated by the RNG 158 to play the games and to determine whether or not to provide an award to a player. In addition, the gaming controller 32 generates game outcomes including combinations of random numbers, and compares the generated combinations with winning combinations stored in the winning combination table to determine if the generated outcome is a winning outcome that is associated with a type of award.

The display controller 168 controls the gaming display 34 to display various images on screens preferably by using computer graphics and image data stored in the memory device 164. More specifically, the display controller 168 controls video reels in a game screen displayed on the first display 146 and/or the second display 148 by using computer graphics and the image data. The display controller 168 is connected to the display device 66 for receiving image data indicative of the player interaction screen 72 for use in displaying the player interaction screen 72 on the gaming display 34. In one embodiment, the display device 66 may be configured to perform the function and operation of the display controller 168 and may be housed within the gaming cabinet assembly 120 of the gaming machine 28. Moreover, the display device 66 may be connected directly to the gaming display 34 to control the gaming display 34 to display various images on screens preferably by using computer graphics and image data stored in the memory device 164.

Figure 7:
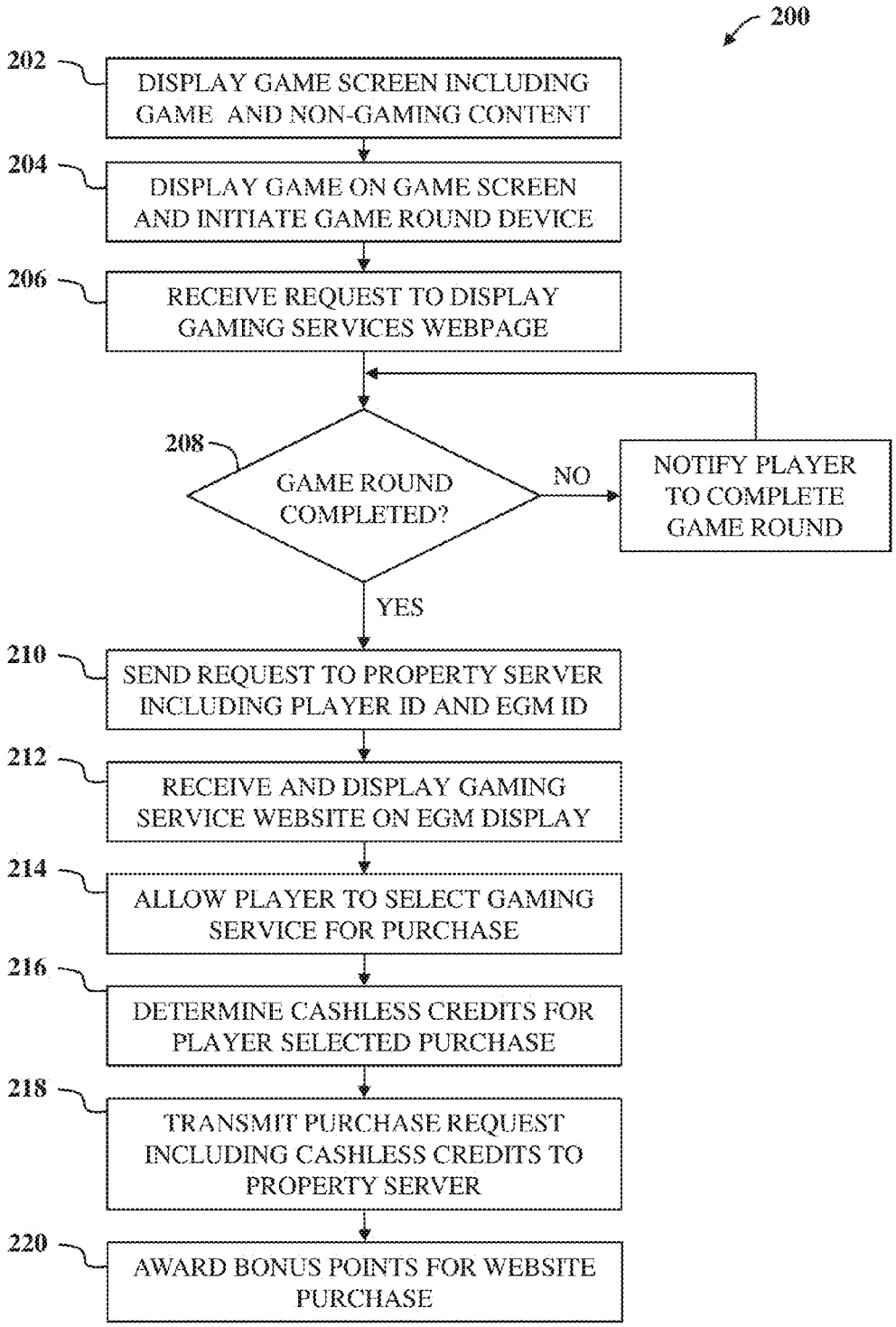
FIG. 7 is a flowchart of a method that may be used with the system shown in FIG. 1 for providing gaming property services to a player, according to an embodiment of the present invention.
Figure 8:
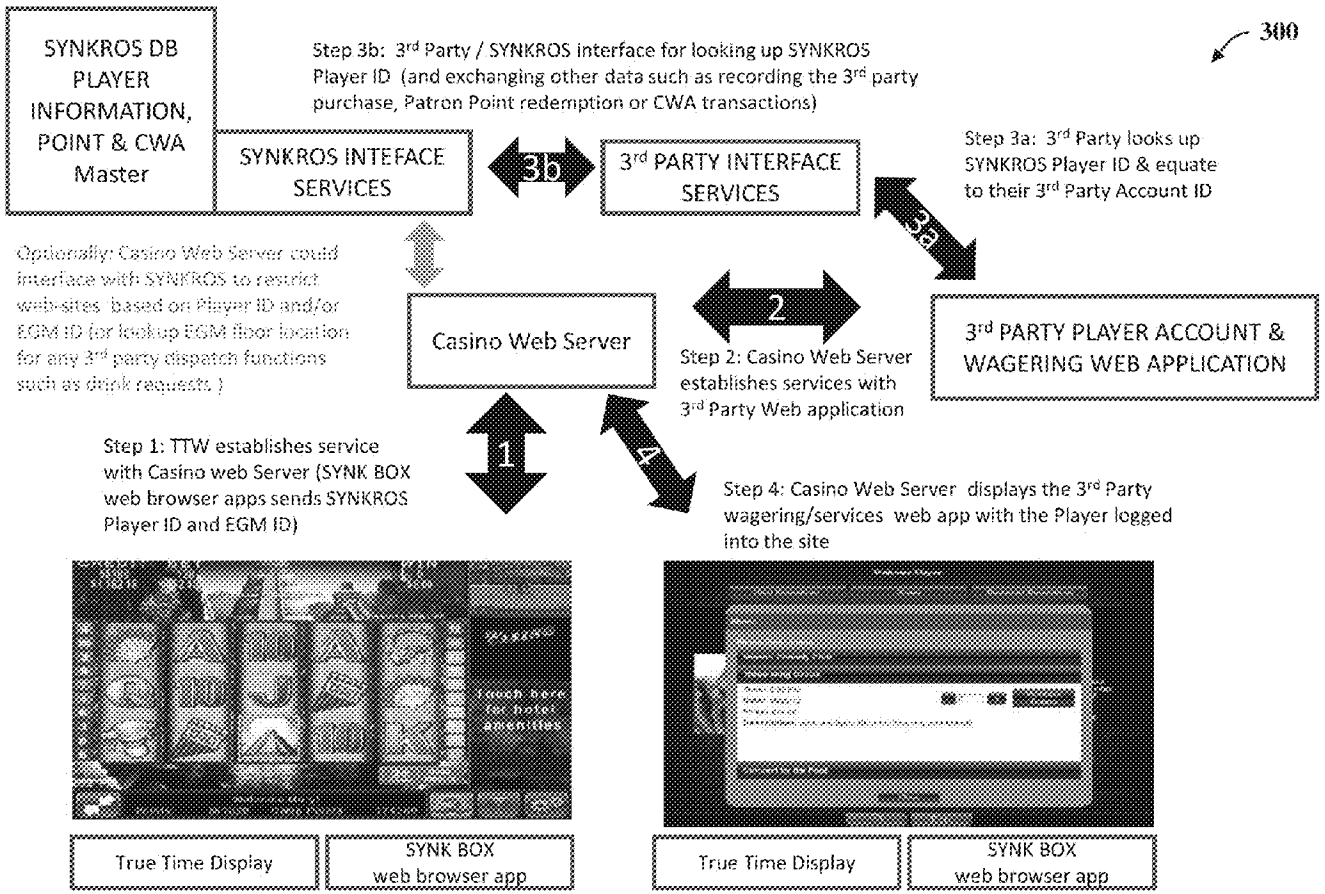
FIG. 8 is a functional diagram of the system shown in FIG. 1, according to an embodiment of the present invention.
Figure 9:
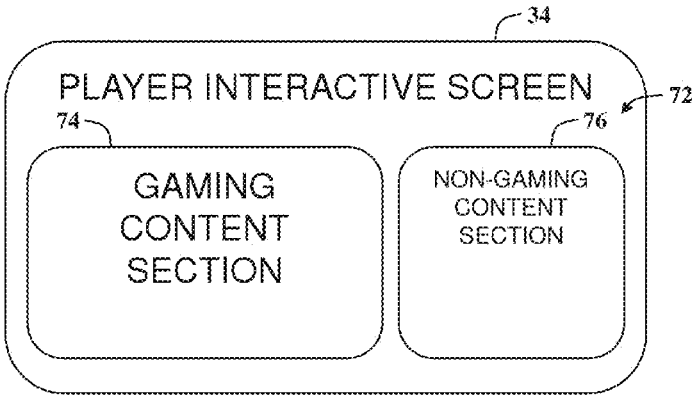
FIGS. 9-26 are exemplary graphical displays of player interaction screens that may be displayed by the system shown in FIG. 1, according to an embodiment of the present invention.

FIG. 7 is a flowchart of a method 200 that may be used with the system 10 for providing gaming property services to a player. The method 200 includes a plurality of steps. Each method step may be performed independently of, or in combination with, other method steps. Portions of the method 200 may be performed by any one of, or any combination of, the components of the system 10. FIG. 8 is a functional diagram of the system 10. FIGS. 9-26 are exemplary graphical displays of player interaction screens 72 that may be displayed by the system 10.

In the illustrated embodiment, in method step 202, the gaming machine 28 receives a request from a player to play a game and/or access gaming services website and responsively displays the player interaction screen 72 on the gaming display 34. For example, in one embodiment, the gaming machine 28 may receive a signal indicative of a wager being placed by the player via the user input device 36 and/or the gaming display 34. In the illustrated embodiment, the display device 66 displays the player interaction screen 72 including a game 78 being displayed in the gaming content section 74 and a services website 80 being displayed in the non-gaming content section 76. In one embodiment, the game 78 is a video slot game. However, it should be noted that the game 78 may be any type of game upon which a player could make a wager including, but not limited to, a keno game, a blackjack game, a video poker game, or any type of game that enables the system 10 to function as described herein.

In method step 204, the gaming controller 32 receives a signal indicative of a wager being placed by the player and responsively initiates a round of the game 78. Moreover, the gaming controller 32 randomly generates an outcome and generates and transmits game data indicative of the outcome to the display device 66. The display device 66 responsively displays the game outcome on the player interaction screen 72.

In the illustrated embodiment, the gaming controller 32 randomly selects a plurality of game symbols 170 from a predefined set of possible game symbols, and displays the selected game symbols 170 associated with the generated game outcome in the game 78. In one embodiment, the game symbols 170 are displayed in a grid 172 having a plurality of cells 174 arranged along a plurality of rows and a plurality of columns. Each cell 174 displays one or more game symbols 170 associated with the game outcome. In the illustrated embodiment, the gaming controller 32 displays the game symbols 170 within a plurality of reels 176. Each reel 176 is associated with a corresponding column. The game 78, in the illustrated embodiment, includes 5 reels 176 with 3 cells 174 per reel, respectively (a "5×3" arrangement). Alternatively, other reel arrangements may be used such as, for example, 3-4-3-4-3, 4-5-5-5-4, or 4-5-4-5-4 arrangements, or arrangements with the same number of cells per column, such as 3×3, 3×4, 4×5, or 5×5 configurations. The game 78 may also include a plurality of paylines 178 that extend across one or more cells 130 to indicate, to the player, a combination of game symbols.

In the illustrated embodiment, the gaming controller 32 receives a signal, from the user input device 36, that is indicative of a player's selection to initiate a gaming session including a wager amount, and a selection of one or more paylines 178 associated with a predefined set of cells 174. In the illustrated embodiment, the game 78 is a multi-line game, i.e., the paylines include horizontal paylines and/or diagonal pay-lines, and/or zig-zag paylines. Moreover, the user input device 16 may allow the player to toggle to increase the bet per payline a credit at a time (up to the maximum bet). The gaming controller 32 randomly generates an outcome of the game 78, and displays the generated outcome on the player interaction screen 72. In one embodiment, the gaming controller 32 is configured to rotate, and/or spin each reel 176 to initiate a game play, and stop each reel 176 to display a plurality of game symbols 170 associated with the randomly generated outcome. In addition, the gaming controller 32 is adapted to determine if the generated outcome is a winning outcome as a function of the displayed primary game symbols 170, a paytable, a wager, and one or more player selected paylines 178. More specifically, the gaming controller 32 determines if a combination of symbols 170 arranged along the selected payline 178 is a winning combination. The gaming controller 32 may provide an award in response to the outcome of the game 78. If a predetermined pattern of primary game symbols 170 is randomly chosen for each cell 174 on a played payline 178, the player may be awarded a payout based on the payline, the wager, and a predetermined paytable. In addition, a player may receive a bonus feature, bonus games, and/or free games based on the combination of primary game symbols 170 associated with the selected payline 178 and/or the appearance of one or more special game symbols in the game outcome. Many variations to the above described general play of a slot game fall within the scope of the present invention. Such slot games are well-known in the art, and are therefore not further discussed.

In method step 206, the gaming tracking device 20 receives a request from the player to display gaming property services on the gaming display 34. Moreover, the player may request to display the services website 80 by initiating the request via the gaming display 34. For example, in one embodiment, the request is initiated when the player selects a predefined area of the player interaction screen 72. The player may initiate a request to display gaming property services by touching the non-gaming content section 76 of the player interaction screen 72 being displayed on the gaming display 34. In another embodiment, the player may initiate via one or more input buttons 122.

In method step 208, the gaming tracking device 20 determines if a current round of the game 78 is being displayed by the display device 66 before displaying the services website 80 on the display device 66. For example, in one embodiment, the gaming tracking device 20 determines if the gaming controller 32 has completed the display of a corresponding game outcome and/or game round, e.g., the reels have been spun and stopped and an award, if any, has been provided, and responsively displays the services website 80. If the outcome of the game 78 is currently being played when the player's request to display gaming property services is received, the gaming tracking device 20 may display a notification message on the gaming display 34 to indicate that game play must be completed prior to displaying the services website 80. In one embodiment, upon determining that the game outcome is currently being displayed, the gaming tracking device 20 may delay displaying the services webpage 80 until the game outcome has been completed.

In method step 210, upon determining that the game round has been competed, the gaming tracking device 20 transmits a webpage request to the gaming property server 56 to display the services website 80 on the gaming display 34. In one embodiment, the gaming tracking device 20 determines the unique player ID associated with the player and transmits the webpage request, including a URL request and the unique player ID. In another embodiment, the gaming tracking device 20 may determine a player account associated with the corresponding unique player ID, and transmit the webpage request, including information associated with the player account to enable the gaming property server 56 to generate gaming services information that is customized based on the information contained in the player account. In addition, the gaming tracking device 20 may determine a unique machine ID associated with the corresponding gaming machine 28 and transmit the webpage request, including the unique machine ID. For example, in one embodiment, upon receiving a request to display gaming property services from the player, the gaming tracking device 20 may request the player to provide the unique player ID such as, inserting a player tracking card and/or providing unique player PIN. In addition, the gaming tracking device 20 may determine a player account associated with the unique player ID and transmit information contained in the player account to the gaming property server 56 such as, for example, cashless wagering credits contained in the player account, player rating, gaming services preference, bonus points, and/or any suitable player information that enables the gaming property server 56 to generate the services website 80 providing information customized for the identified player.

In method step 212, the gaming tracking device 20 receives webpage data indicative of the gaming property services from the gaming property server 56 in response to the webpage request and responsively displays the services website 80 including the gaming property services received from the gaming property server 56. More specifically, the gaming tracking device 20 receives the webpage data from the gaming property server 56, generates the services website 80 using the embedded web browser program 68, and transmits the services website 80 to the display device 66 for use in displaying the services website 80 on the gaming display 34.

In method step 214, the gaming tracking device 20 allows the player to select a gaming service for purchase via the services website 80. Moreover, the gaming tracking device 20 transmits information between the player and the gaming property server 56 via the services website 80 to facilitate providing gaming property services to the player. In addition, the gaming tracking device 20 monitors the player's activity on the services website 80 and determines if the player has selected to purchase a gaming property service.

In method step 216, the gaming tracking device 20 detects a purchase of gaming property services being made by the player and determines an amount of cashless credits and/or bonus points required for the selected purchase.

In method step 218, the gaming tracking device 20 determines a corresponding amount of cashless credits and/or bonus points sufficient to compete the purchase in the corresponding player account, and generates and transmits a purchase request including the selected services and the corresponding credit/bonus points amount to the gaming property server 56. Upon receipt of the purchase request, the gaming property server 56 confirms the purchased services including the corresponding amount of credits/bonus points, and sends a confirmation message to the gaming tracking device 20. Upon receiving the confirmation message, the gaming tracking device 20 deducts the corresponding amount of cashless credits and/or bonus points used for the purchase from the corresponding player account and updates the player account in the database 46.

In method step 220, the gaming tracking device 20 determines if the player's purchase and/or activity with the services website 80 is a qualifying purchase/activity and responsively provides the award to the player, based on the purchase and/or activity performed with the services website 80. For example, the gaming tracking device 20 may receive an award message from the gaming property server 56 indicating that the player's activity qualifies for an award of bonus points and/or cashless credits, and responsively provides the award to the player and credits the corresponding player account with the awarded bonus points and/or cashless credits. In addition, the gaming tracking device 20 may display a notification message on the gaming display 34 to notify the player of the qualifying purchase and/or activity and the corresponding award.

Figure 10:
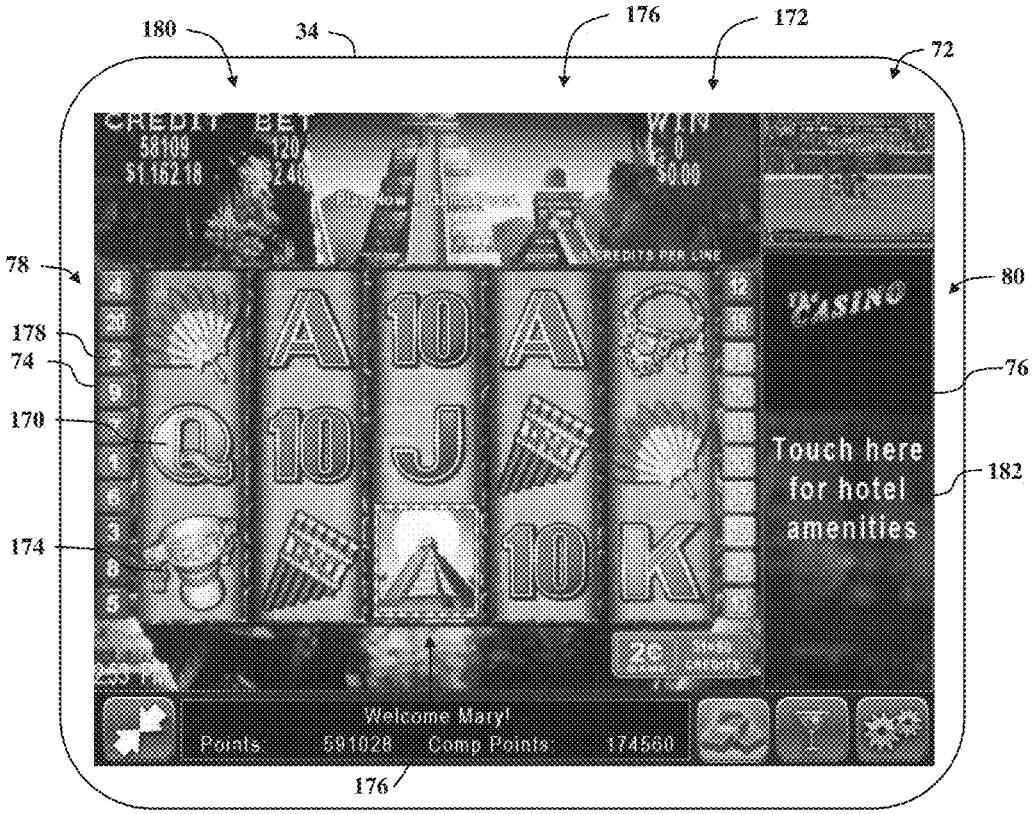
Figure 11:
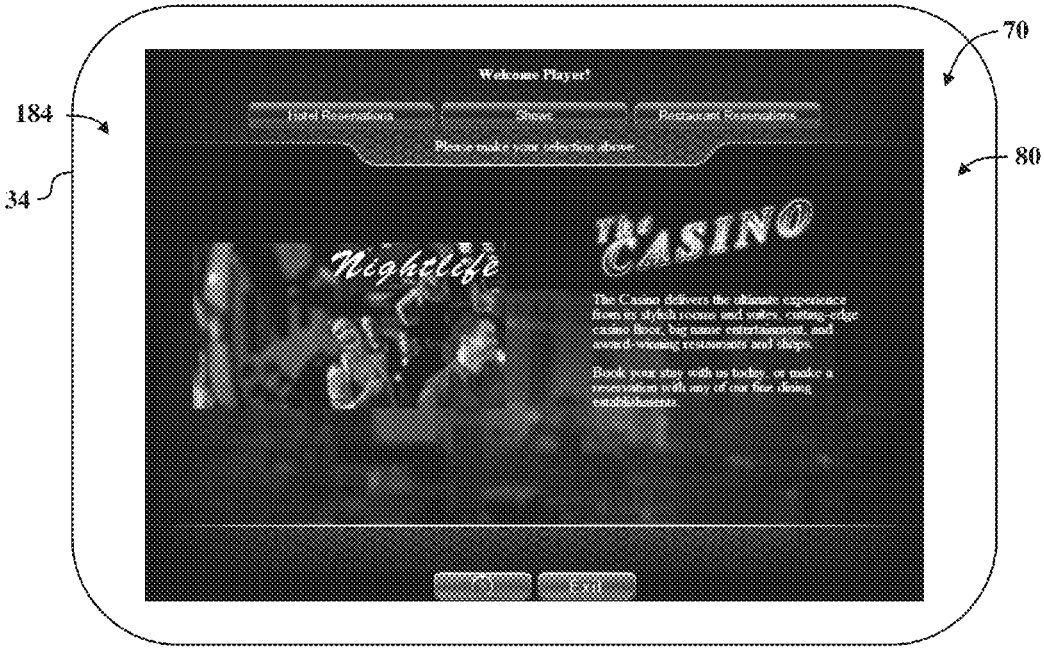
Figure 12:
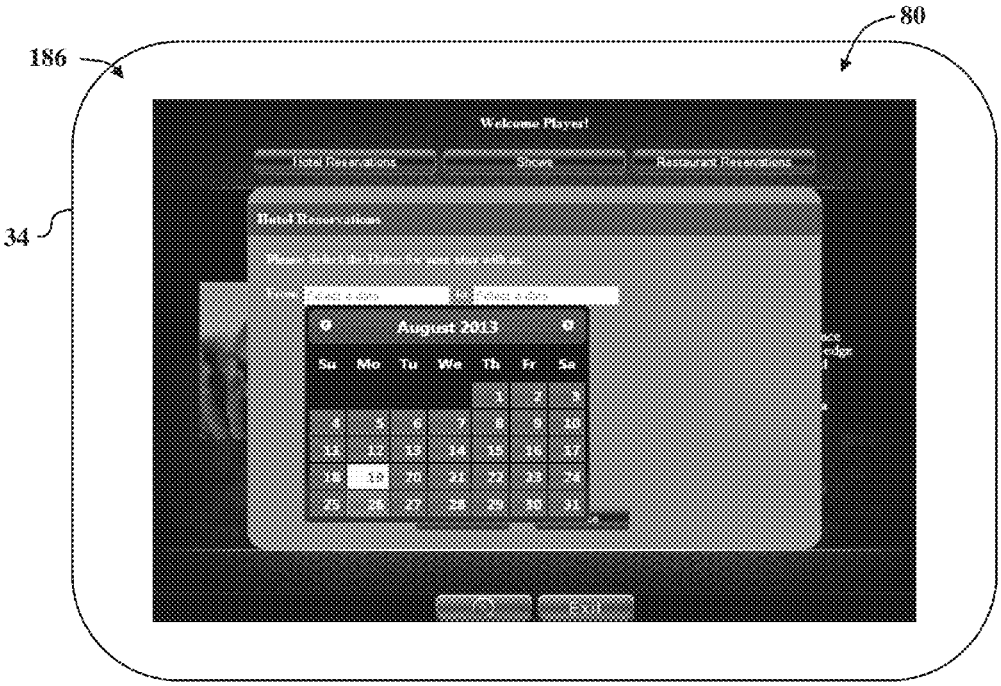
Figure 13:
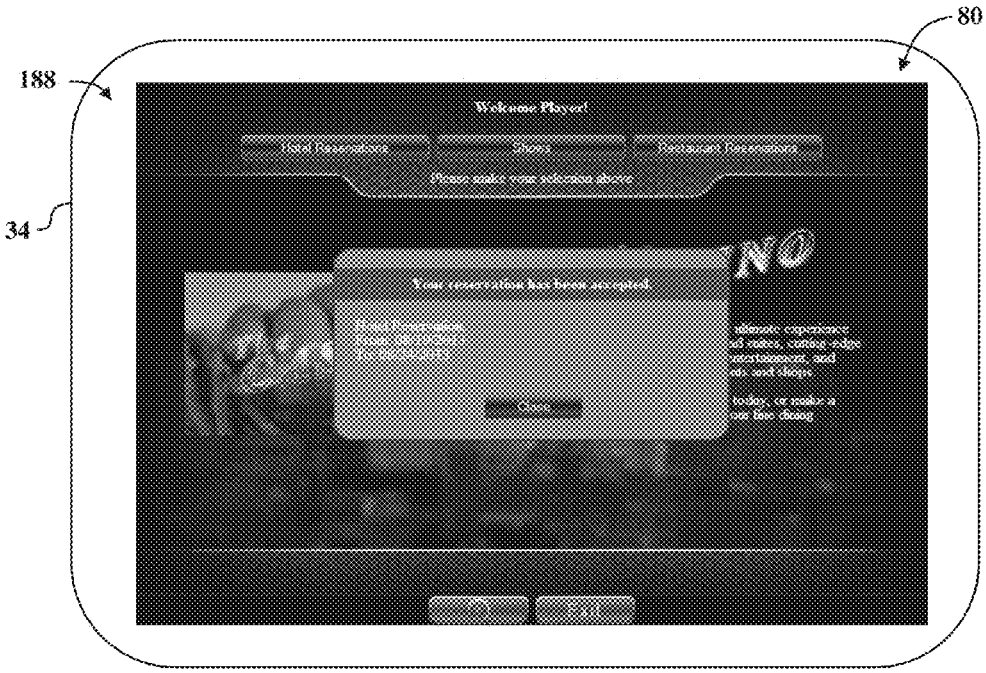
Figure 14:
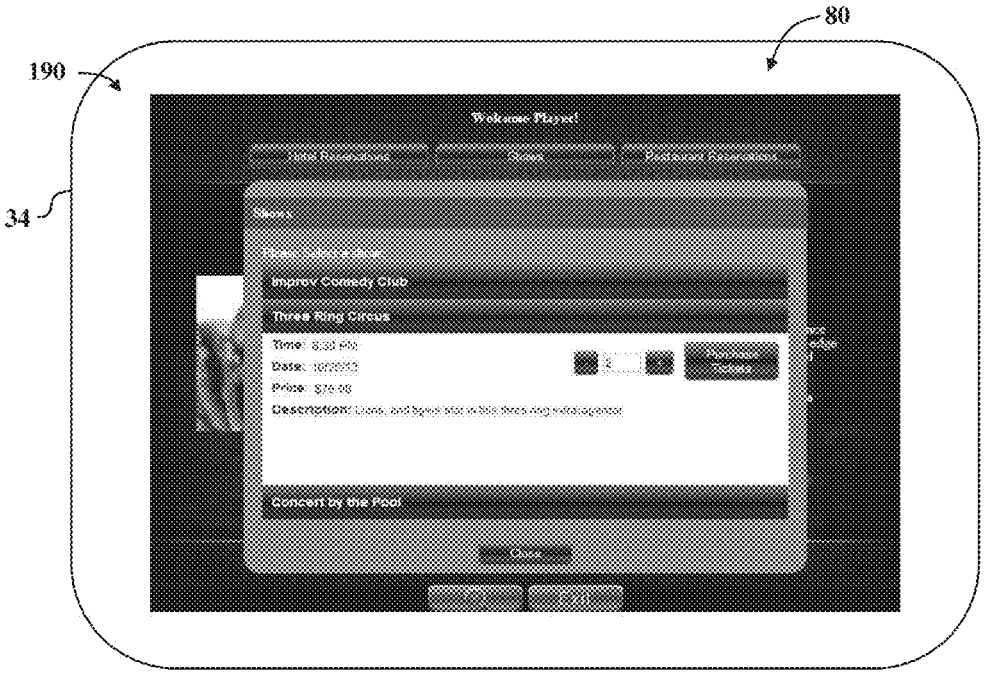
Figure 15:
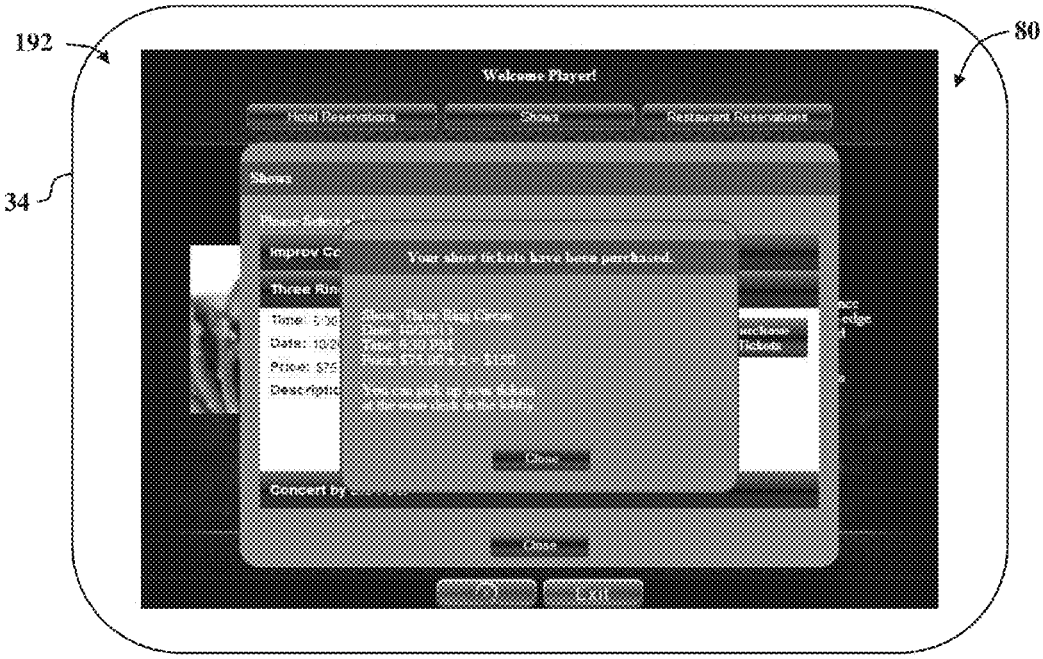
Figure 16:
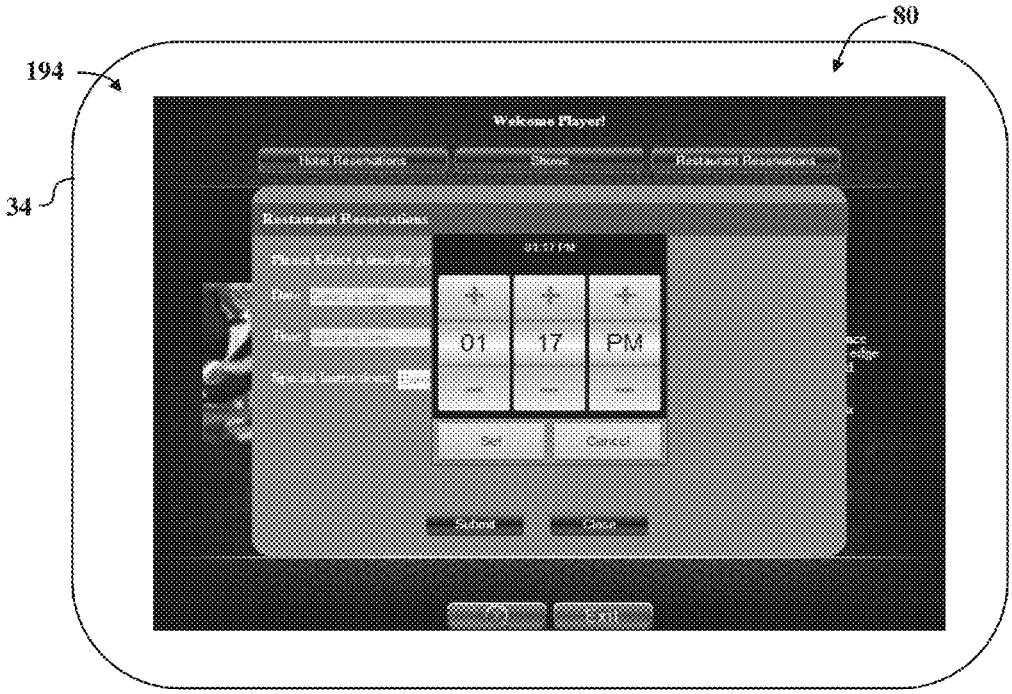
Figure 17:
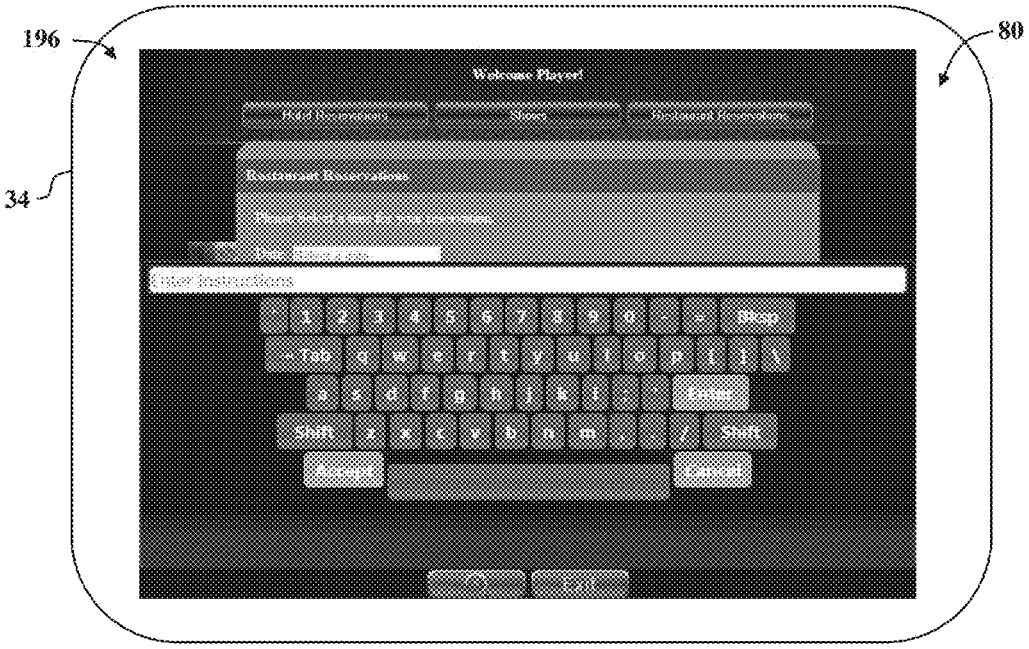
Figure 18:
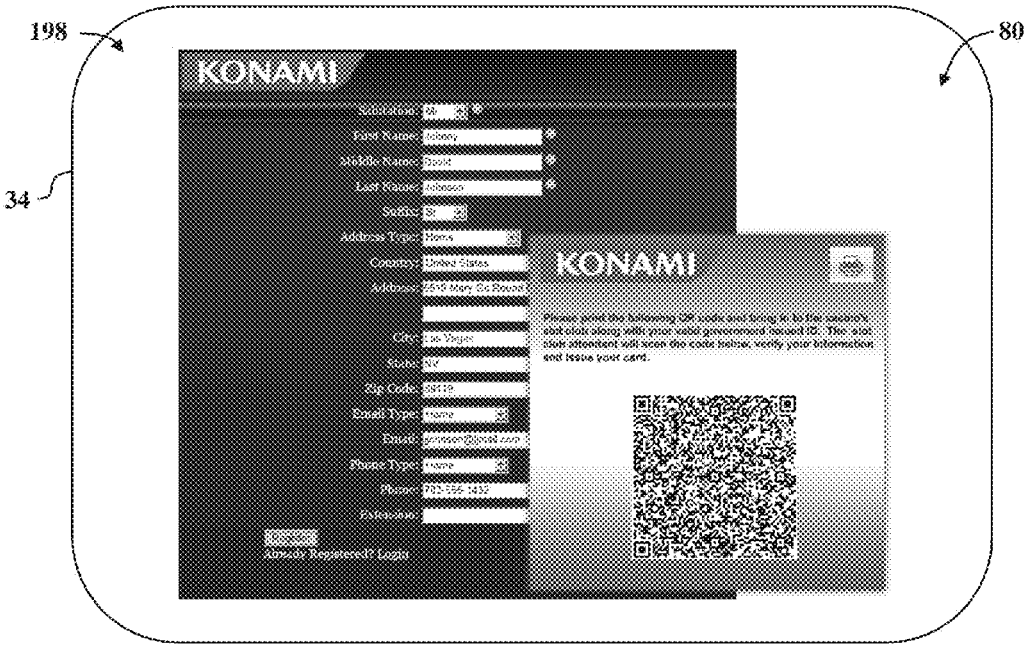

FIG. 8 is a functional diagram of the system 10 including method 300 illustrating a logical data flow of SYNKROS Web Systems 10. FIG. 10 is a graphical display of a player interaction screen 72 including a True Time Window (TTW) 180 with Slide Panel 182 (Casino Web Site). FIG. 11 is a graphical display of a player interaction screen 72 including a Casino Web Page 184. FIG. 12 is a graphical display of a player interaction screen 72 including a 3rd Party Hotel Reservation Web Page 186. FIG. 13 is a graphical display of a player interaction screen 72 including a 3rd Party Hotel Web Page 188. FIG. 14 is a graphical display of a player interaction screen 72 including a 3rd Party Show Reservation Web Page 190. FIG. 15 is a graphical display of a player interaction screen 72 including a 3rd Party Show Reservation Web Page 192. FIG. 16 is a graphical display of a player interaction screen 72 including a 3rd Party Restaurant Reservation Web Page 194. FIG. 17 is a graphical display of a player interaction screen 72 including a 3rd Party Restaurant Reservation Web Page 196.

In the illustrated embodiment, the system 10 is configured to transmit data indicative of the player interaction screen 72 to the gaming device 12 to enable the player to access the player management system 18, the gaming property management system 14, and/or the 3rd party service system 16 via the gaming device 12. The system 10 is configured to display the player interaction screen 72 including a web browser that enables the player to interact with the systems 14, 16, and 18 through a web interface. In the illustrated embodiment, the gaming device 12 is configured to simultaneously display a game and the player interaction screen 72 on the gaming device 12 to enable the player to play the game and to purchase goods and services, and/or access player account information via the gaming device 12.

The system 10 includes embedded software that runs on the SYNK Box, e.g., gaming tracking device 20, and includes a generic touch screen enabled web browser (similar to Internet Explorer). When configured with True Time Display hardware (Picture-in-Picture on the EGM 28), a side panel can be used to establish a touch screen enabled web browser session to the casino web server 56 (shown in FIG. 10, TTW Slide Panel 182).

Referring to FIG. 8 and as illustrated in Step 1, the embedded web browser establishes a connection to the casino web server 56. As part of the URL request, the SYNKROS Player ID, as well as the SYNKROS EGM ID of the EGM 28, that the player is playing is sent.

The casino web server 56 uses the Player ID to identify the player and any SYNKROS information contained in the player account about that player including their wager history and card level. With this information, the casino web server 56 is able to grant or restrict access to which web sites (i.e., services) the player can view or interact with on the True Time Display 180. Refer to FIG. 11, Casino Web Page 184. For example, the casino web page 184 may use the player ID to identify the player as a VIP, and displays the casino website 184 showing access to Hotel Reservations, Show Reservations and Restaurant Reservations with the Hotel Reservations Web Page 186. Similarly, other services could be added such as Valet, SportsBook, and Point of Sale to request free Drinks.

The casino web server 56 may also use the EGM ID to identify the location of the player on the casino floor. With this information, the casino web server 56 is able to grant or restrict what web sites the player has access to. For example, if the identified EGM 28 is not in the High Limits room, the access to a Point of Sale Drink Request may not enabled. Furthermore, 3rd party web applications that need to dispatch a casino employee to the player may use the EGM ID to identify the zone, bank and/or stand associated with the EGM 28 to locate the player on the casino floor.

Table 1 below lists examples of services that may be provided through the embedded web browser in the gaming tracking device 20 via the gaming display 34 (True Time Window).

TABLE 1

| Website or SYNKROS Interaction | |
|---|---|
| Casino Web Site or 3rd Party Integrated Web Site | SYNKROS Information/Transactions |
| PMS Hotel with reservations | Comps view, issue, redeem |
| Point of Sale (Drink/Food Ordering) | Casino Offers |
| Restaurant reservations | Player card tiers |
| Event registration | Player Points (view and redeem on 3rd Party Web Site) |
| Valet | Player Cashless Wagering Accounts (use Funds on Deposit to purchase/wager on 3rd Party Web Site |
| SportsBook, Poker, Tournament | |

Illustrated as Step 2, with the player identified and the player's location identified, the system 10 and/or the casino web server 56 may redirect the player to a 3rd party website. The 3rd party website (or internal casino web site) can now be displayed directly on the EGM 28 (step 4) and the player can interact with the embedded web page via the touch screen gaming display 34.

As illustrated in Step 3*a*, the casino property web server 56 may also pass the player's identification and player's location to the 3rd party web server 60. The 3rd party web server 60 communicates with the SYNKROS player management system 18 (illustrated as Step 3*b*) and uses the website interface to perform multiple functions such as match the SYNKROS player ID to identify the player's account on the 3rd party system 16 (i.e., the Player's Sportsbook Web account), request the player's point balance so the player could use their casino points on the SportsBook website or to pay for a drink or show tickets the player orders via the 3rd party website. Through the 3rd party website, the 3rd party system 16 may also record any purchase to SYNKROS player management system 18 so the player could receive points for the purchase, etc.

Illustrated as Step 4, the result from the previous steps displays a targeted web page from the 3rd party web server 60 to the player on the EGM 28. This 3rd party website 186 or casino webpage 184 now knows who the player is and where they are located to customize the services to the player. The player interacts with the 3rd party website using the True Time Display 180 as a touch screen enabled web page. Processing of any financial transactions such as credit card, etc., are the same as if the player was using a PC or Mobile device at home. Through step 3*a*, it could even be possible for the 3rd Party to access the Player's Cashless wagering account (Fund on Deposit).

Figure 4:
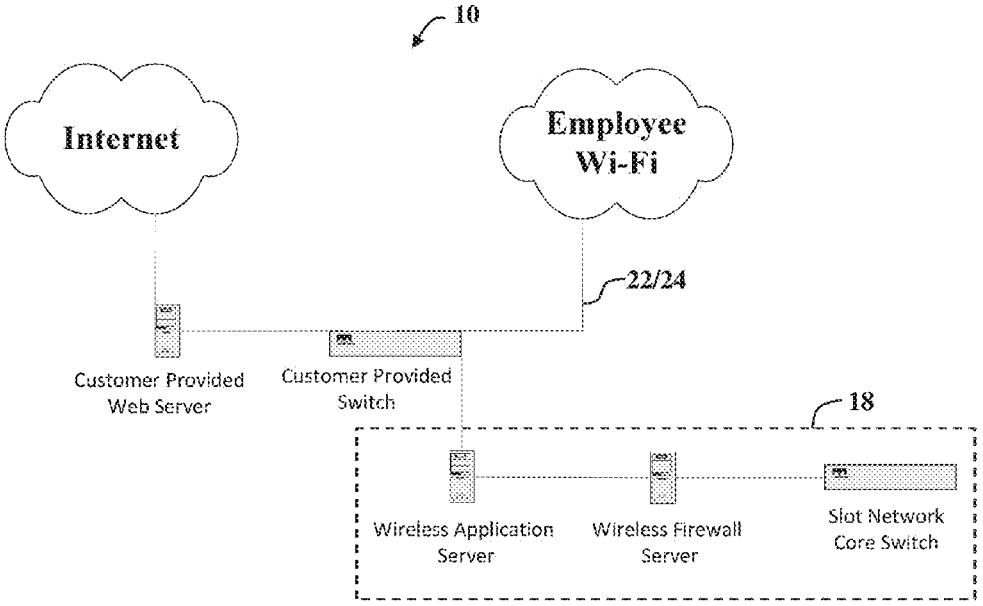
FIG. 4 is a schematic view of a gaming device and a gaming tracking device that may be used with the system shown in FIGS. 1 and 2, according to an embodiment of the present invention.

Referring to FIG. 4, in one embodiment, the player management system web server 40 may be configured to communicate with gaming device 12 via a wireless network within the casino environment to display gaming services on mobile computing devices 26. FIGS. 18-26 are additional graphical displays of player interaction screens 72 that may be displayed by the system 10. In the illustrated embodiment, the system controller 38 may include a Konetic mobile application that includes SYNKROS web portable objects that are incorporated into the casino web server 56 and/or the player management system web server 40. Moreover the web server 40 may be configured to display a SYNKROS patron web portal 198 on the mobile gaming device 12. In one embodiment, the SYNKROS web portal is a "sample" web space developed utilizing HTML, Java Script and PHP. Interface Layer: the web portal 198 interacts with the SYNKROS player management system 18 via an iWare's Konetic mobile application interface plug-in and/or additional database views based on interface requirements. The web portal will have the same network components and server requirements as the Konetic Mobile Apps.

Cascading Style Sheets (CSS). The Konetic mobile application allows the system controller 38 to utilize a CSS is that includes a set of style rules that tell a browser how to present a document. Therefore, a customer user may alter the CSS style instructions to customize and repose the sample documents provided with the web portal 198 (to make their own look-and-feel).

Feature List. The following features are currently implemented in the web portal: Patron Sign-up (shown in FIG. 18). The Patron Sign-up option allows a casino employee to insert a patron account into the SYNKROS player management system 18. In addition, in one embodiment, the Patron Sign-up page may display a printable slip containing QA code that contains all information in the sign-up questionnaire. The QR code can then be scanned into any Patron Sign-up form within the SYNKROS player management system 18 when equipped with a standard QR capable scanner. In addition, the player may take a picture of the EGM screen to capture the QR code to bring it to a Club booth to scan.

Figure 19:
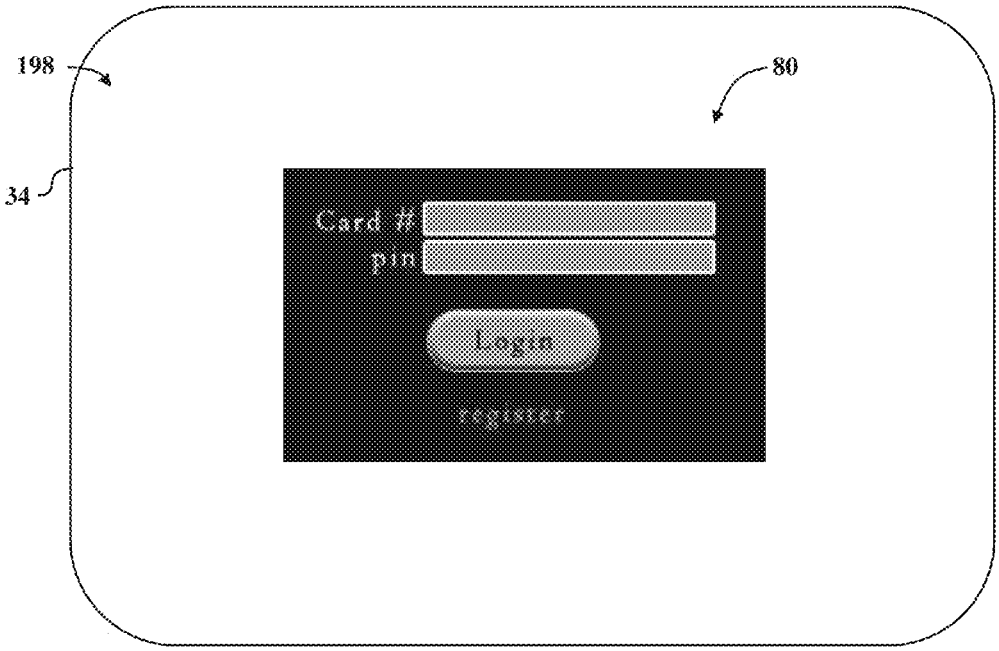

Sign In (shown in FIG. 19). The existing patron can login by entering their Card ID and PIN. A successful login will give the patron access to his/her patron info and various options as described below.

Figure 20:
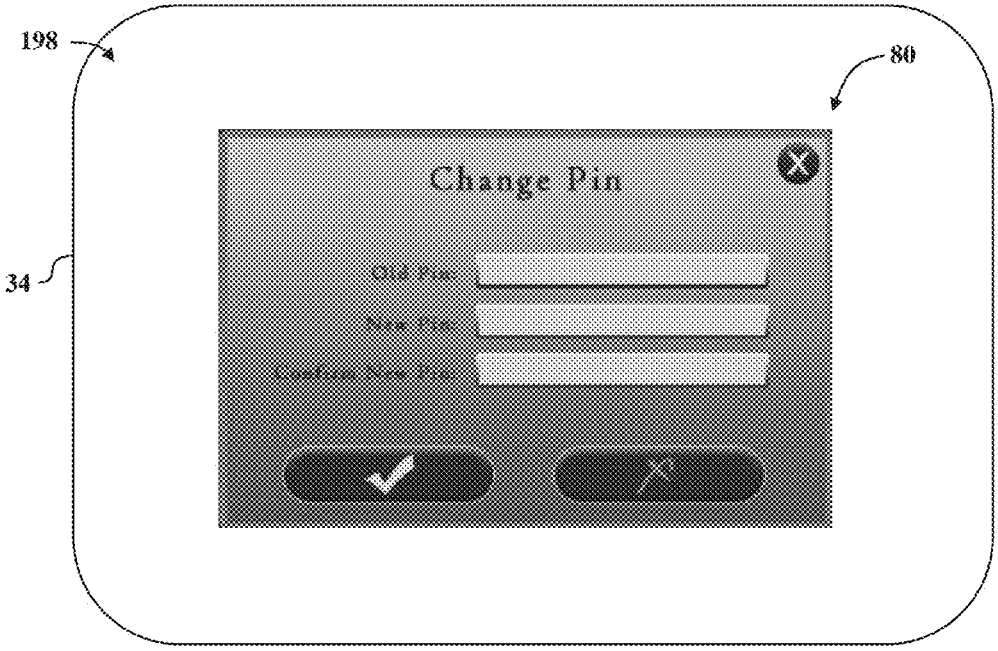

Change PIN (shown in FIG. 20). A patron can change his/her PIN as long as they know their current PIN. Otherwise, they will have to see the casino patron club to reset the PIN from within the SYNKROS player management system 18.

Figure 21:
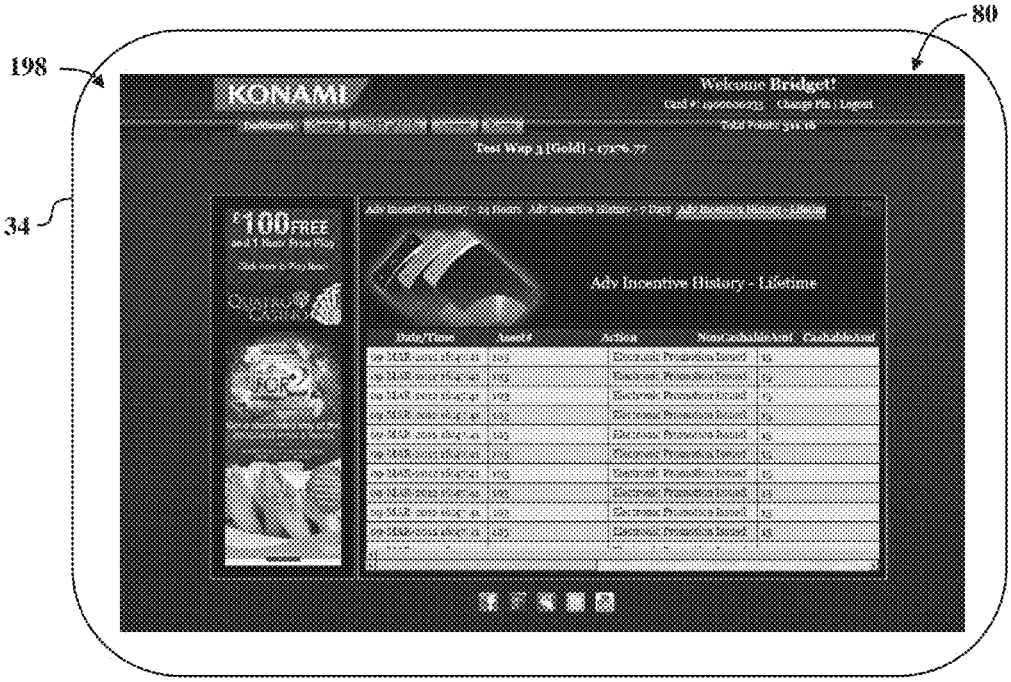
Figure 22:
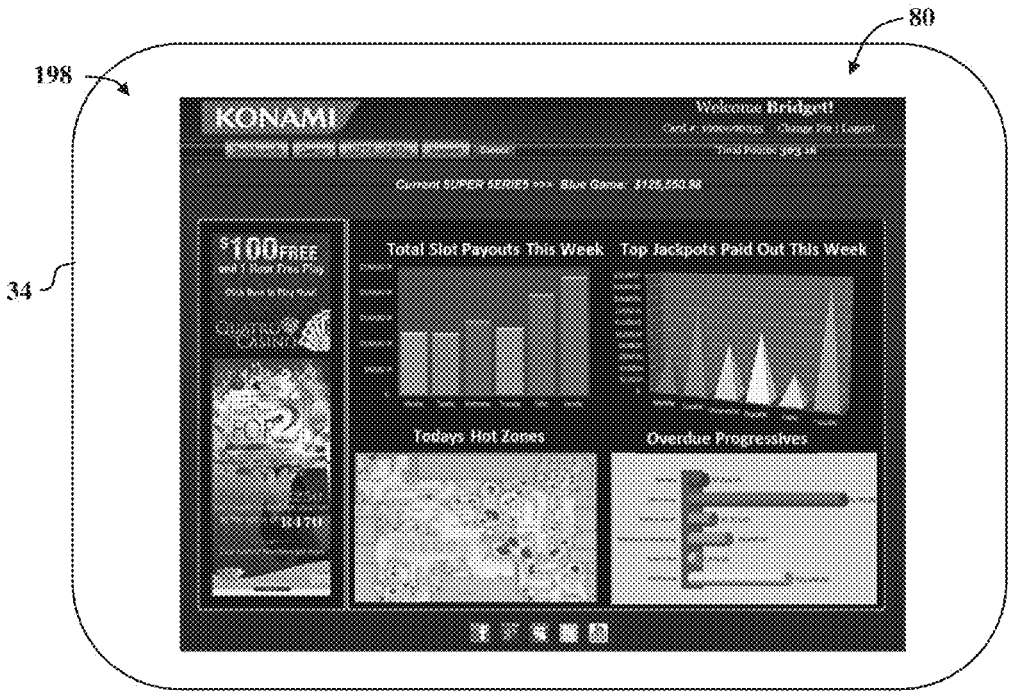

Dashboards (shown in FIGS. 21 and 22). Patron Dashboards are visual representation of queries that can be defined and customized by the casino. The queries can be any information the casino wants to make available for online patron review. The data can be displayed in a standard grid, or as a graphical chart or graph. The DB table that holds the queries has an additional field that determines the display option ("Grid, Bar Chart, Pie Graph Line Chart, etc).

Figure 23:
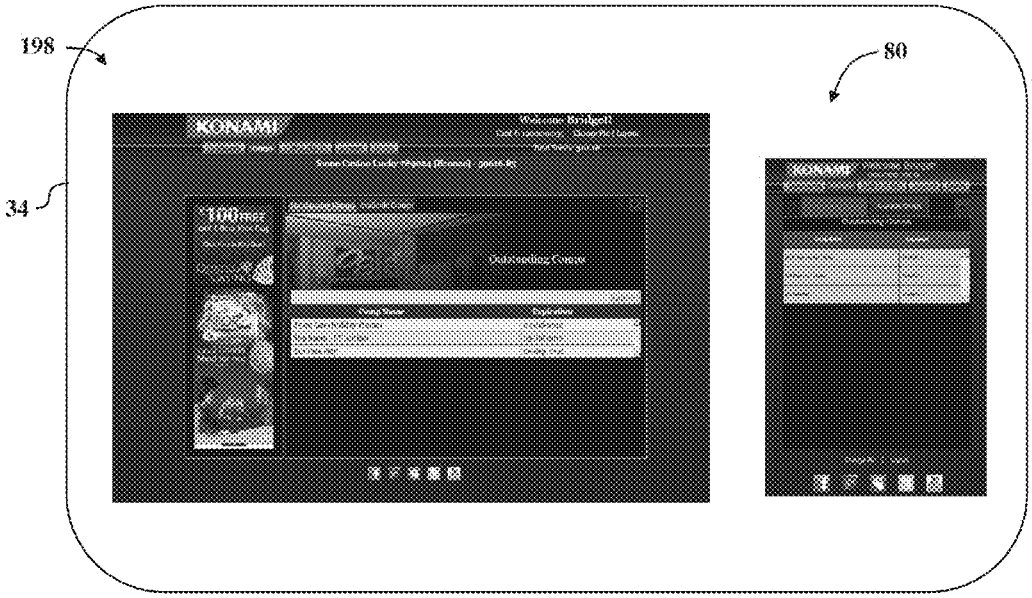

Comp Management (shown in FIG. 23). The Comps tab provides a facility for the patron to view existing comps as well as self-issue new comps based on eligibility. The same screen may be configured for a desk top browser, EGM display, or a mobile browser. When an employee accesses the SYNKROS patron web portal 198, the system controller 38 can determine the type of platform the user is running and automatically resize or completely reformat based on the screen target default screen size.

Figure 24:
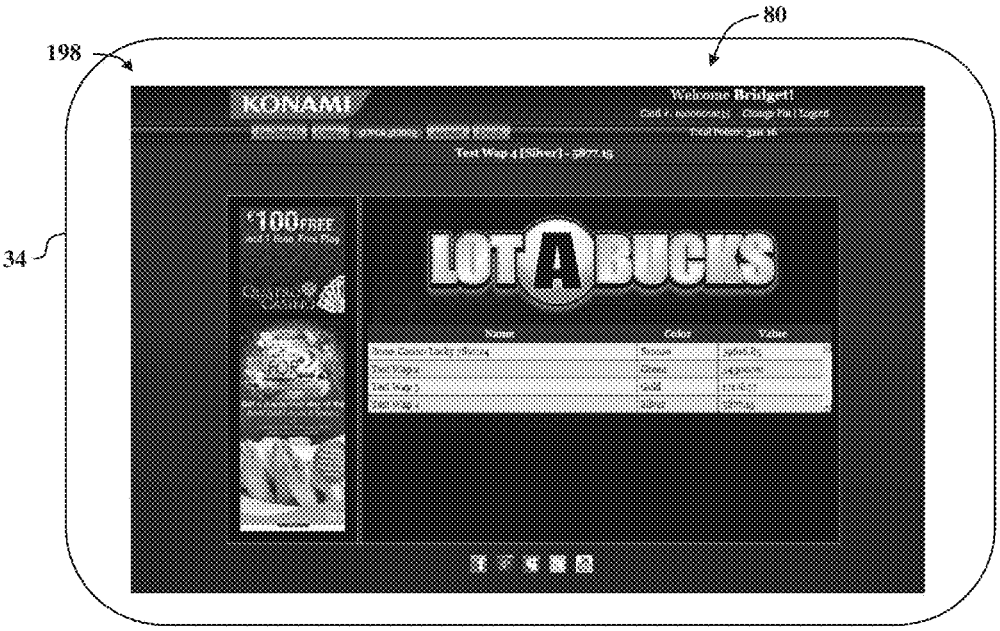

Super Series (shown in FIG. 24). The SUPER SERIES tab shows the current SUPER SERIES progressive amounts if any are configured and running on the target gamesite.

Figure 25:
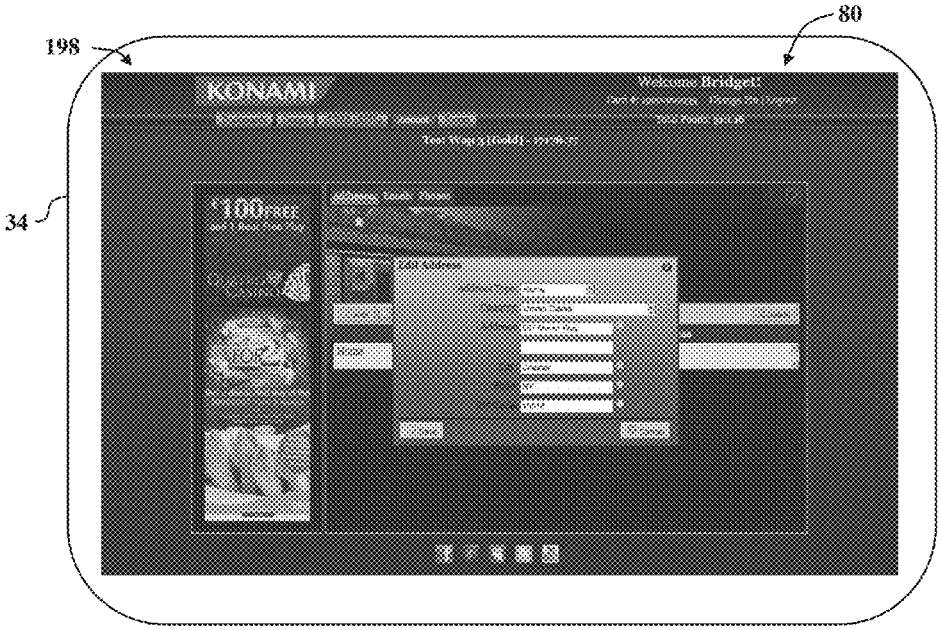

Account Management (shown in FIG. 25). Account Management allows a patron to modify his/her addresses, emails, or phone numbers. This may be jurisdictionally prohibited, so the CSS can omit the form from the available view port.

Figure 26:
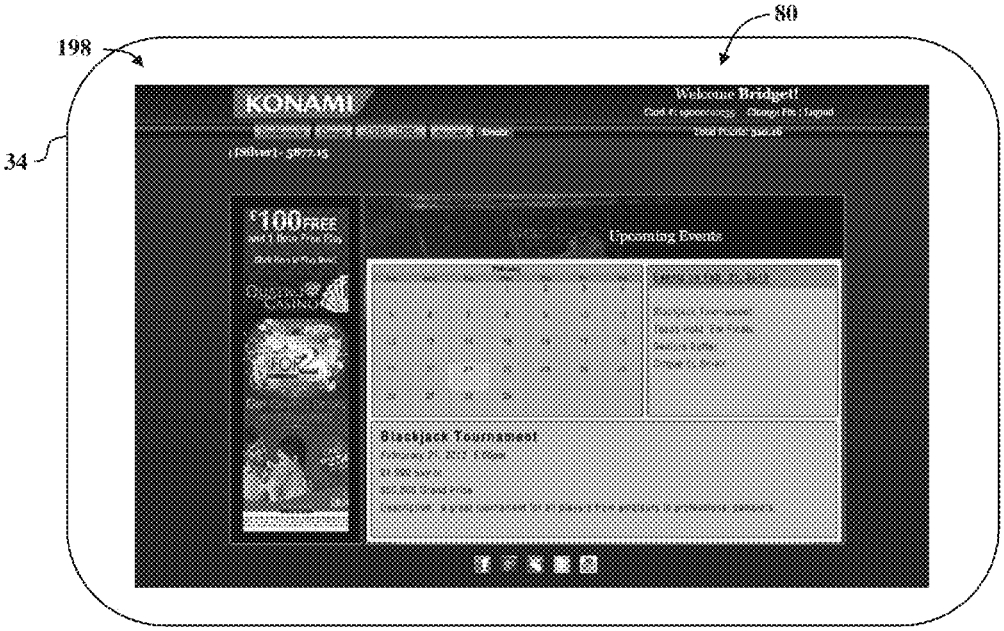

Events (shown in FIG. 26). The Events tab will display a calendar of Events in which the user has been invited, as well as significant dates such as Birthday, Sign-up Anniversary, Wedding Anniversary, etc.

Additional features enabled by the web portal include: Graphical Machine locator (relevant if using a mobile device), Patron Win/Loss Statement requests (printable if allowed by jurisdiction), RSVP for event invitations, and additional features as requested by casino operators.

Exemplary embodiments of a system and method for providing gaming property services to a player are described above in detail. The system and method are not limited to the specific embodiments described herein, but rather, components of the system and/or steps of the method may be utilized independently and separately from other components and/or steps described herein. For example, the system may also be used in combination with other wagering systems and methods, and is not limited to practice with only the system as described herein. Rather, an exemplary embodiment can be implemented and utilized in connection with many other monitoring applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor. Processors may execute one or more program applications, such as a web browser (e.g., Microsoft Internet Explorer, Mozilla Firefox, Apple Safari, Google Chrome, and Opera, etc.), to access and view content over a computer network. In particular implementations, the program applications allow a user to enter addresses of specific network resources to be retrieved, such as resources hosted by a networking system. These addresses can be Uniform Resource Locators, or URLs. In addition, once a page or other resource has been retrieved, the client applications may provide access to other pages or records when the user "clicks" on hyperlinks to other resources. By way of example, such hyperlinks may be located within the webpages and provide an automated way for the user to enter the URL of another page and to retrieve that page. A webpage or resource embedded within a webpage, which may itself include multiple embedded resources, may include data records, such as plain textual information, or more complex digitally encoded multimedia content, such as software programs or other code objects, graphics, images, audio signals, videos, and so forth. One prevalent markup language for creating webpages is the Hypertext Markup Language (HTML). Other common web browser-supported languages and technologies include the Extensible Markup Language (XML), the Extensible Hypertext Markup Language (XHTML), JavaScript, Flash, ActionScript, Cascading Style Sheet (CSS), and, frequently, Java.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

In some embodiments, a network, as describe herein, includes a network addressable system that, in various example embodiments, comprises one or more physical servers and data stores. The one or more physical servers are operably connected to a computer network via, by way of example, a set of routers and/or networking switches. In an example embodiment, the functionality hosted by the one or more physical servers may include web or HTTP servers, FTP servers, as well as, without limitation, webpages and applications implemented using Common Gateway Interface (CGI) script, PHP Hyper-text Preprocessor (PHP), Active Server Pages (ASP), Hyper Text Markup Language (HTML), Extensible Markup Language (XML), Java, JavaScript, Asynchronous JavaScript and XML (AJAX), Flash, ActionScript, and the like. Data stores may store content and data relating to, and enabling, operation of the networking system as digital data objects. A data object, in particular implementations, is an item of digital information typically stored or embodied in a data file, database or record. Content objects may take many forms, including: text (e.g., ASCII, SGML, HTML), images (e.g., jpeg, tif and gif), graphics (vector-based or bitmap), audio, video (e.g., mpeg), or other multimedia, and combinations thereof. Content object data may also include executable code objects (e.g., games executable within a browser window or frame), podcasts, etc. Data stores corresponds to one or more of a variety of separate and integrated databases, such as relational databases and object-oriented databases, that maintain information as an integrated collection of logically related records or files stored on one or more physical systems.

For example, the processes described herein may be implemented using hardware components, software components, and/or any combination thereof. By way of example, while embodiments of the present disclosure have been described as operating in connection with a networking website, various embodiments of the present invention can be used in connection with any communications facility that supports web applications. Furthermore, in some embodiments the term "web service" and "website" may be used interchangeably and additionally may refer to a custom or generalized API on a device, such as a mobile device (e.g., cellular phone, smart phone, personal GPS, personal digital assistance, personal gaming device, etc.), that makes API calls directly to a server. The specification and drawings are, accordingly, to be regarded in an illustrative rather than a restrictive sense. It will, however, be evident that various modifications and changes may be made thereunto without departing from the broader spirit and scope of the invention as set forth in the claims and that the invention is intended to cover all modifications and equivalents within the scope of the following claims This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A system for use in providing gaming property services to a player, comprising:

a gaming property server for use in providing the gaming property services to the player; and a gaming machine including:

a gaming display for use in displaying a player interaction screen to the player;

a display device coupled to the gaming display, the display device including a display controller configured to display the player interaction screen on the gaming display, the player interaction screen including a gaming content section for displaying the game and a non-gaming content section for displaying a web browser interface; and a gaming controller coupled to the display device, the gaming controller configured to randomly generate an outcome of a game and transmit game data indicative of the outcome to the display device; and a gaming tracking device coupled to the gaming machine and the gaming property server, the gaming tracking device including a processor programmed to receive the gaming property services from the gaming property server and transmit services data indicative of the gaming property services to the display device, the display device configured to receive the game data and the services data from the gaming controller and the gaming tracking device, respectively, and display the outcome of the game within the gaming content section and the gaming property services within the non-gaming content section on the player interaction screen, the processor of the gaming tracking device is programmed to:

execute a web browser program to display the web browser interface within the non-gaming content section to enable the player to access a website;

receive a signal from the gaming machine including a service request from the player to display and interact with the website to receive the gaming property services;

transmit the service request received from the player to the gaming property server and receive a response signal from the gaming property server including the gaming property services;

determine if the gaming machine is displaying a current game round in progress on the player interaction screen; and upon determining that the display of the current game round has been completed, transmit webpage data including the gaming property services to the display device to display the website including the webpage data on the player interaction screen and enlarge a size of the non-gaming content section to display the website, wherein the gaming tracking device is programmed to display a notification message on the display device upon determining the current game round has not been completed, the notification message indicating that game play must be completed prior to displaying the website.

2. The system in accordance with claim 1, the gaming tracking device configured to receive the webpage data indicative of the gaming property services from the gaming property server, generate a services webpage as a function of the received webpage data, and transmit the services webpage to the display device for use in displaying the services webpage on the gaming display.

3. The system in accordance with claim 2, the gaming tracking device configured to transmit information between the player and the gaming property server via the services webpage to facilitate providing the gaming property services to the player.

4. The system in accordance with claim 2, the gaming tracking device configured to transmit a webpage request to the gaming property server to display the services webpage on the gaming display, the webpage request including a URL and a unique player identifier associated with the player for use by the gaming property server to determine the gaming property services as a function of the unique player identifier.

5. The system in accordance with claim 4, the gaming tracking device configured to determine a unique machine identifier associated with the gaming machine and transmit the webpage request including the unique machine identifier, the gaming property server configured to determine a location of the gaming machine as a function of the unique machine identifier and to determine the gaming property services as a function of the location of the gaming machine.

6. The system in accordance with claim 2, the gaming tracking device configured to determine if the player purchases a gaming property service through the services webpage and responsively provide an award to the player as a function of the purchased gaming property service.

7. The system in accordance with claim 2, the gaming tracking device configured to determine a player account associated with the player, the player account including an amount of bonus points, and allow the player to purchase the gaming property services via the services webpage using bonus points contained in the player account.

8. The system in accordance with claim 7, the gaming tracking device configured to allow the player to purchase the gaming property services via the services webpage using cashless wagering credits associated with the player account.

9. The system in accordance with claim 1, further comprising a middleware server coupled to the gaming property server, the gaming tracking device is configured to communicate with a middleware server to receive gaming services from the gaming property server via the middleware server.

10. A gaming machine for use in providing gaming property services to a player, comprising:

a gaming display for use in displaying a player interaction screen to the player;

a display device coupled to the gaming display, the display device including a display controller configured to display the player interaction screen on the gaming display, the player interaction screen including a gaming content section for displaying the game and a non-gaming content section for displaying a web browser interface;

a gaming controller coupled to the display device, the gaming controller configured to randomly generate an outcome of a game and transmit game data indicative of the outcome to the display device; and a gaming tracking device coupled to the display device, the gaming tracking device including a processor programmed to transmit services data indicative of the gaming property services to the display device, the display device configured to receive the game data and the services data from the gaming controller and the gaming tracking device, respectively, and display the outcome of the game within the gaming content section and the gaming property services within the non-gaming content section on the player interaction screen, the processor of the gaming tracking device is programmed to:

execute a web browser program to display the web browser interface within the non-gaming content section to enable the player to access a website;

receive a service request from the player to display and interact with the website to receive the gaming property services;

transmit the service request received from the player to a gaming property server and receive a response signal from the gaming property server including the gaming property services;

determine if a current game round is being displayed in progress on the player interaction screen; and upon determining that the display of the current game round has been completed, transmit webpage data including the gaming property services to the display device to display the website including the webpage data on the player interaction screen and enlarge a size of the non-gaming content section to display the website, wherein the gaming tracking device is programmed to display a notification message on the display device upon determining the current game round has not been completed, the notification message indicating that game play must be completed prior to displaying the website.

11. The gaming machine in accordance with claim 10, the gaming tracking device configured to:

transmit a webpage request to a gaming property server including a URL and a unique player identifier associated with the player for use by the gaming property server to determine the gaming property services as a function of the unique player identifier;

receive the webpage data indicative of the gaming property services from the gaming property server; and display the services website including the webpage data received from the gaming property server.

12. The gaming machine in accordance with claim 11, the gaming tracking device configured to determine a unique machine identifier associated with the gaming machine and transmit the webpage request including the unique machine identifier for use by the gaming property server to determine a location of the gaming machine as a function of the unique machine identifier and to determine the gaming property services as a function of the location of the gaming machine.

13. The gaming machine in accordance with claim 10, the gaming tracking device configured to determine if the player purchases a gaming property service through the services website and responsively provide an award to the player as a function of the purchased gaming property service.

14. The gaming machine in accordance with claim 10, the gaming tracking device configured to determine a player account associated with the player, the player account including an amount of bonus points, and allow the player to purchase the gaming property services via the services website using at least one of the bonus points and cashless wagering credits contained in the player account.

15. The gaming machine in accordance with claim 10, wherein the gaming tracking device is configured to communicate with a middleware server to receive gaming services from the gaming property server via the middleware server.

16. A method of for use in providing gaming property services to a player via a gaming machine, including the steps of:

receiving, by a gaming controller, a signal indicative of a wager being placed by the player and responsively generating an outcome of a game;

receiving, by a gaming tracking device, a request from the player to display gaming property services;

receiving, by the gaming tracking device, webpage data indicative of the gaming property services from a gaming property server and generating a services website including the gaming property services, the services website being configured to allow the player to purchase the gaming property services via the services website;

displaying, by the gaming tracking device, a player interaction screen on a display device of the gaming machine, the player interaction screen including a gaming section displaying the outcome of the game and a non-gaming section displaying the services website;

receiving, by the gaming tracking device, a signal including a service request from the player to display and interact with the services website to receive the gaming property services;

transmitting, by the gaming tracking device, the service request received from the player to the gaming property server and receiving a response signal from the gaming property server including the gaming property services;

determining, by the gaming tracking device, if the gaming machine is displaying a current game round in progress on the player interaction screen and upon determining that the display of the current game round has been completed, transmitting the webpage data including the gaming property services to the display device to display the website including the webpage data on the player interaction screen and enlarging a size of the non-gaming content section to display the website;

determining if the player purchased the gaming property services via the services website and responsively providing an award to the player as a function of the purchased gaming property services; and, displaying a notification message on the display device upon determining the current game round has not been completed, the notification message indicating that game play must be completed prior to displaying the website.

17. The method in accordance with claim 16, including the steps of:

determining a unique player identifier associated with the player and a unique machine identifier associated with the gaming machine;

transmitting a webpage request to the gaming property server including a URL, the unique player identifier, and the unique machine identifier for use in generating the gaming property services; and receiving the webpage data indicative of the gaming property services from the gaming property server; and displaying the services website including the received webpage data on the player interaction screen.

18. The method in accordance with claim 17, including the steps of:

determining a player account associated with the player as a function of the unique player identifier;

determining an amount of bonus points and cashless wagering credits included in the player account; and allowing the player to purchase the gaming property services via the services website with the bonus points and the cashless wagering credits included in the player account.

19. One or more non-transitory computer-readable storage media, having computer-executable instructions embodied thereon, wherein when executed by at least one processor, the computer-executable instructions cause the processor to:

display a player interaction screen on a gaming display, the player interaction screen including a gaming content section for displaying the game and a non-gaming content section for displaying a web browser interface;

randomly generate an outcome of a game and display the outcome within the gaming content section on the player interaction screen;

receive a signal including a service request from the player to display gaming property services;

transmit the service request received from the player to a gaming property server and receive webpage data indicative of the gaming property services from the gaming property server;

determine if the gaming machine is displaying a current game round in progress on the player interaction screen and, upon determining that the display of the current game round has been completed, display a services website including the gaming property services on the player interaction screen and enlarge a size of the non-gaming content section to display the services website, the services website being configured to allow a player to purchase gaming property services via the services website;

determine if the player purchased the gaming property services via the services website and responsively provide an award to the player as a function of the purchased gaming property services; and, display a notification message on the display device upon determining the current game round has not been completed, the notification message indicating that game play must be completed prior to displaying the website.

20. The one or more computer-readable storage media according to claim 19, the computer-executable instructions cause the processor to:

determine a unique player identifier associated with the player and a unique machine identifier associated with the gaming machine;

transmit a webpage request to the gaming property server including a URL, the unique player identifier, and the unique machine identifier for use in generating the gaming property services; and receive the webpage data indicative of the gaming property services from the gaming property server; and display the services website including the received webpage data on the player interaction screen.

21. The one or more computer-readable storage media according to claim 20, the computer-executable instructions cause the processor to:

determine a player account associated with the player as a function of the unique player identifier;

determine an amount of bonus points and cashless wagering credits included in the player account; and allow the player to purchase the gaming property services via the services website with the bonus points and the cashless wagering credits included in the player account.

* * * * *